US011290814B1

(12) United States Patent
Hook et al.

(10) Patent No.: US 11,290,814 B1
(45) Date of Patent: Mar. 29, 2022

(54) METHOD, APPARATUS, AND COMPUTER-READABLE STORAGE MEDIUM FOR MODULATING AN AUDIO OUTPUT OF A MICROPHONE ARRAY

(71) Applicant: Valeo North America, Inc., Troy, MI (US)

(72) Inventors: Brandon Hook, Troy, MI (US); Daniel Soberal, Troy, MI (US)

(73) Assignee: Valeo North America, Inc., Troy, MI (US)

( * ) Notice: Subject to any disclaimer, the term of this patent is extended or adjusted under 35 U.S.C. 154(b) by 0 days.

(21) Appl. No.: 17/122,949

(22) Filed: Dec. 15, 2020

(51) Int. Cl.

| | |
|---|---|
| ***H04R 3/00*** | (2006.01) |
| ***H04R 1/40*** | (2006.01) |
| ***H04R 29/00*** | (2006.01) |
| ***G10L 25/78*** | (2013.01) |
| ***H04R 3/04*** | (2006.01) |
| ***G10L 21/0232*** | (2013.01) |
| *G10L 21/0216* | (2013.01) |

(52) U.S. Cl.
CPC ..... *H04R 3/005* (2013.01); *G10L 21/0232* (2013.01); *G10L 25/78* (2013.01); *H04R 1/406* (2013.01); *H04R 3/04* (2013.01); *H04R 29/005* (2013.01); *G10L 2021/02166* (2013.01); *H04R 2410/01* (2013.01)

(58) Field of Classification Search
CPC ..... H04R 3/005; H04R 3/04; H04R 1/406; H04R 29/005; H04R 2410/01; G10L 21/0232; G10L 25/78; G10L 2021/02166
USPC ..... 381/56, 58, 86, 91, 92, 122, 124
See application file for complete search history.

(56) References Cited

U.S. PATENT DOCUMENTS

| | | | | |
|---|---|---|---|---|
| 9,516,409 | B1 * | 12/2016 | Ramprashad ..... | H04R 1/406 |
| 2004/0111258 | A1 * | 6/2004 | Zangi ..... | G10L 21/02 704/226 |
| 2010/0241426 | A1 | 9/2010 | Zhang et al. | |
| 2011/0235822 | A1 | 9/2011 | Jeong et al. | |
| 2012/0179458 | A1 | 7/2012 | Oh et al. | |
| 2012/0224715 | A1 | 9/2012 | Kikkeri | |
| 2013/0142343 | A1 | 6/2013 | Matsui et al. | |

(Continued)

FOREIGN PATENT DOCUMENTS

EP 2 551 849 A1 1/2013

*Primary Examiner* — William A Jerez Lora
(74) *Attorney, Agent, or Firm* — Oblon, McClelland, Maier & Neustadt, L.L.P.

(57) ABSTRACT

A method, apparatus, and computer-readable storage medium that modulate a composition of an audio output in accordance with a noise level of an environment. For instance, the present disclosure describes a method for modulating an audio output of a microphone array, comprising receiving two or more audio signals from two or more microphone capsules in the microphone array, each audio signal comprising an electrical noise of a corresponding microphone capsule and a response to acoustic stimuli in an environment perceived by the microphone capsule, estimating an acoustic contribution level of the environment based on the received audio signals, and determining, by processing circuitry, a composition of the audio output of the microphone array based on the estimated acoustic contribution level of the environment, the composition being based on at least a relationship between acoustic noise and directivity indices of each of a plurality of beamformers.

20 Claims, 14 Drawing Sheets

(56) References Cited

U.S. PATENT DOCUMENTS

| | | | | |
|---|---|---|---|---|
| 2013/0142349 | A1 | 6/2013 | Liu et al. | |
| 2016/0360314 | A1 | 12/2016 | Iyengar et al. | |
| 2017/0309294 | A1 | 10/2017 | Gannot et al. | |
| 2017/0352349 | A1 | 12/2017 | Vrazic | |
| 2018/0033447 | A1* | 2/2018 | Ramprashad | G10L 21/0216 |
| 2019/0212189 | A1* | 7/2019 | Cho | H04R 1/08 |
| 2021/0204059 | A1* | 7/2021 | Trestain | H04R 3/005 |

* cited by examiner

METHOD, APPARATUS, AND COMPUTER-READABLE STORAGE MEDIUM FOR MODULATING AN AUDIO OUTPUT OF A MICROPHONE ARRAY

BACKGROUND

Field of the Disclosure

The present disclosure relates to the use of beamformers in variable noise environments. In particular, the present disclosure relates to operation and control of an in-car communication system of a vehicle.

Description of the Related Art

The utility of beamforming is impacted by a number of factors that, in a dynamic acoustic environment, are ever-changing. For instance, given a predefined microphone array and particular beamformer design, dynamic noise levels within the surrounding acoustic environment may result in, at times, the introduction of obfuscating electrical self-noise and, at others, undesirable beamwidth and spatial aliasing. In this way, implementation of a particular, statically-defined beamformer design may be insufficient for accurately processing a variety of acoustic conditions in real-time.

Considered in the context of a vehicle, conversation between passengers of a vehicle, particularly when traveling at moderate or high speeds, can be made difficult by road noise, engine noise, audio noise, and other types of typically elevated ambient sounds. In-car communication systems, accordingly, have sought to augment natural hearing by providing enhanced communication features. High acoustic noise environments, however, continue to hamper the ability of microphone arrays of an in-car communication system to identify intended speech, amongst noise, in an optimal manner. In an effort to provide increasingly accurate speech processors and improvements in signal-to-noise ratio, new approaches must be considered.

Accordingly, in order to achieve optimal signal-to-noise ratios, a practical approach to beamforming, which can be applied generally as well as in the automotive environment, need be developed.

The foregoing "Background" description is for the purpose of generally presenting the context of the disclosure. Work of the inventors, to the extent it is described in this background section, as well as aspects of the description which may not otherwise qualify as prior art at the time of filing, are neither expressly or impliedly admitted as prior art against the present invention.

SUMMARY

The present disclosure relates to a method, apparatus, and computer-readable storage medium comprising processing circuitry configured to perform a method for modulating an audio output of a microphone array.

According to an embodiment, the present disclosure further relates to a method for modulating an audio output of a microphone array, comprising receiving two or more audio signals from two or more microphone capsules in the microphone array, each audio signal comprising an electrical noise of a corresponding microphone capsule and a response to acoustic stimuli in an environment perceived by the microphone capsule, estimating an acoustic contribution level of the environment based on the received audio signals, and determining, by processing circuitry, a composition of the audio output of the microphone array based on the estimated acoustic contribution level of the environment, the composition being based on at least a relationship between acoustic noise and directivity indices of each of a plurality of beamformers.

According to an embodiment, the present disclosure further relates to an apparatus for modulating an audio output of a microphone array, comprising processing circuitry configured to receive two or more audio signals from two or more microphone capsules of a plurality of microphone capsules in the microphone array, each audio signal comprising an electrical noise of a corresponding microphone capsule and a response to acoustic stimuli in an environment perceived by the corresponding microphone capsule, estimate an acoustic contribution level of the environment based on the received audio signals, and determine a composition of the audio output of the microphone array based on the estimated acoustic contribution level of the environment, the composition being based on at least a relationship between acoustic noise and directivity indices of each of a plurality of beamformers.

According to an embodiment, the present disclosure further relates to a non-transitory computer-readable storage medium storing computer-readable instructions that, when executed by a computer, cause the computer to perform a method for modulating an audio output of a microphone array, the method comprising receiving two or more audio signals from two or more microphone capsules in the microphone array, each audio signal comprising an electrical noise of a corresponding microphone capsule and a response to acoustic stimuli in an environment perceived by the microphone capsule, estimating an acoustic contribution level of the environment based on the received audio signals, and determining a composition of the audio output of the microphone array based on the estimated acoustic contribution level of the environment, the composition being based on at least a relationship between acoustic noise and directivity indices of each of a plurality of beamformers.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). Reference throughout this document to "one embodiment", "certain embodiments", "an embodiment", "an implementation", "an example" or similar terms means that a particular feature, structure, or characteristic described in connection with the embodiment is included in at least one embodiment of the present disclosure. Thus, the appearances of such phrases or in various places throughout this specification are not necessarily all referring to the same embodiment. Furthermore, the particular features, structures, or characteristics may be combined in any suitable manner in one or more embodiments without limitation.

According to an embodiment, the present disclosure describes a method for modulating an output of a microphone array in order to optimize a signal-to-noise ratio thereof. Though it will be appreciated the methods described herein may be implemented within a variety of settings, including hands-free calling, voice over internet protocol, voice recognition, and zonal vehicle-to-vehicle conferencing, among others. In particular, the methods of the present disclosure can be implemented within the context of in-car communication, as will be described below in view of exemplary embodiments.

Figure 1:
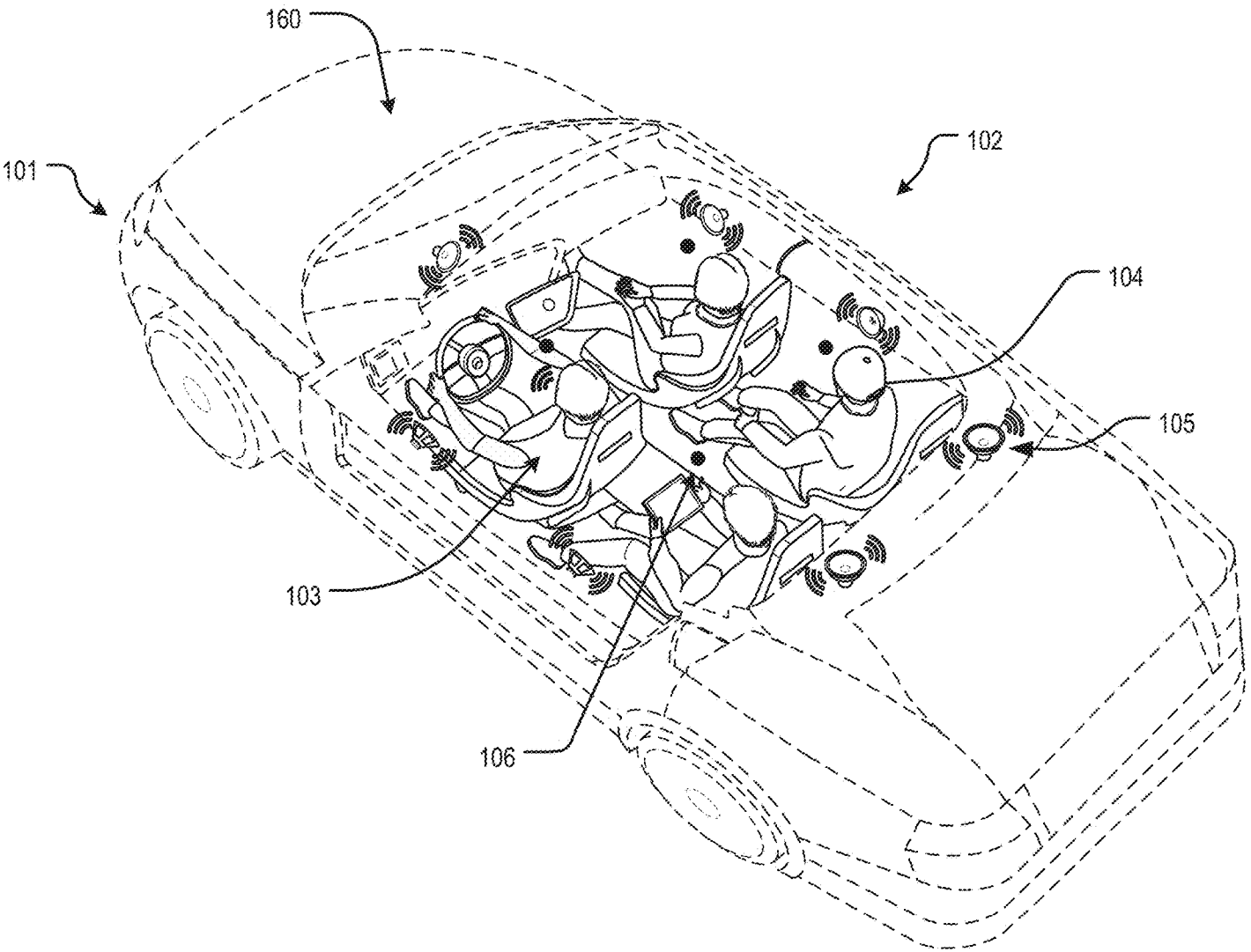
FIG. 1 is an illustration of an in-car communication system of a vehicle, according to an exemplary embodiment of the present disclosure.

Accordingly, FIG. 1 is an illustration of an in-car communication system 102 of a vehicle 101. The vehicle 101 may include an electronics control unit (ECU) 160 configured to perform a method of the in-car communication system 102, such as a method of modulating an audio output of a microphone array. The ECU 160 may be in communication with and control of a plurality of microphones 106 of the vehicle 101 and a plurality of speakers 105 of the vehicle 101. Each of the plurality of microphones 106 of the vehicle 101 can be mounted throughout a cabin of the vehicle 101, including within a headliner of the vehicle 101, as shown in an exemplary embodiment of FIG. 1. In an embodiment, a portion of the plurality of microphones 106 of the vehicle 101 may form a microphone array, as is the focus of the present disclosure. As shown in FIG. 1, a plurality of passengers 104 can be in the vehicle 101, including a driver 103. It should be noted that 'microphone' and 'microphone capsule' may be used interchangeably through the present disclosure and are intended to suggest similar devices for detecting and transducing acoustic signals.

Under standard operation of the in-car communication system 102 of the vehicle 101, speech from each of the plurality of passengers 104 of the vehicle 101 can be enhanced and transmitted to each of the other passengers of the plurality of passengers 104 of the vehicle 101 to ensure that communication is not impeded and that all passengers have the opportunity to participate in vehicle conversation.

In practice, however, such operation of the in-car communication system can be impeded by the dynamic acoustic noise environment of the vehicle, thus resulting in sub-optimal performance. In fact, and as introduced above, in-car communication systems often fail to optimally identify and augment speech in a vehicle due to dynamic levels of acoustic noise. In a vehicle, acoustic noise can be generated by noise from a heating, ventilation, and air conditioning system, noise from wind hitting the outside of the vehicle, noise from contact between the tire and the road surface, noise from other events outside the vehicle, including horns, sirens, and the like, and noise from competing talkers in the vehicle (i.e., passengers). Moreover, a volume of acoustic noise from the above-described sources fluctuates with a number of factors including, among others, vehicle speed and external weather events. With a variety of possible sources of acoustic noise, and in view of unknown volumes of noise generated thereby, efforts have been made to tune microphones and processing methods to better interrogate audio signals and isolate the signal from the noise.

Initially, these efforts were generally directed to acoustic noise environments. In one instance, these efforts included a least norm solution, or similar mathematical optimization, as a strategy to arrive at a maximal signal-to-noise ratio (SNR) for a given number of microphones, or microphone capsules, and set of polar constraints. This approach, however, while effectively rejecting ambient noise (a result of a respective polar pattern), increases white noise amplification. In another instance, these efforts included an adaptive direction of arrival technique, or similar technique that enables null-steering toward a dominant noise source, as a strategy to maximally reduce noise originating for a single spatial origin. Notably, this approach can maintain a constant main lobe toward the desired source while nulling toward identified directive noise sources (e.g. jingling keys in an ignition). While isolating certain noises, this approach demonstrates poor robustness in capturing the exact location of a talker as an identified directive noise source in the absence of a large, impractical number of microphones. Moreover, such an approach is more effective at reducing noise from acoustic noise sources whose noise is itself directionally coherent and/or well estimated by direction of arrival techniques. Coherent noise sources, however, are all but absent from vehicle travel. Road noises, for instance, generate diffuse noise that would not be well captured by the above-described approach. These approaches introduce a paradox wherein an approach which creates the most desirable beamwidth, and a beam which is consistent across all frequencies up to the point of aliasing; also happens to result in the highest amount of electrical self-noise, the electrical self-noise being inversely proportional to frequency.

In view of these sub-optimal approaches, the present disclosure describes an apparatus and method of modulating an audio output of a microphone array that is capable of handling the varied acoustic environment of the vehicle. In an embodiment, the apparatus and method of the present disclosure can be implemented within a microphone array including a plurality of microphones (e.g, three or more microphones). The apparatus and method of the present disclosure, as detailed in the remainder of the disclosure, is capable of generating high SNR enhancement in a diffuse noise field, including at low frequencies, as well as a constant polar pattern across a wide frequency range without spatial aliasing.

According to an embodiment, the advantages of the apparatus and method of the present disclosure, as described above, can be achieved in a small form factor package.

Moreover, such advantages can be achieved with an understanding of the complex acoustic environment of the vehicle. For instance, in a space with high levels of acoustic background noise, such as may be the case in the vehicle of FIG. 1 when traveling at high speeds, microphone array directivity may be critical in capturing signals of interest. In the loud environment of a vehicle, the impact of electrical noise, described later, becomes negligible and so the advantages of increasing microphone array directivity can be exploited. While increasing microphone array directivity effectively reduces acoustic 'noise', increases in directionality also increase electrical noise, or electrical self-noise, particularly at lower frequencies. In another instance, such as may be the case in the vehicle of FIG. 1 when traveling at moderate speeds and with a relatively quiet acoustic background, the impact of electrical self-noise, or self-noise, of each microphone of a microphone array becomes significant. In this relatively low noise environment, directivity of the microphone array may be relaxed in order to balance self-noise with acoustic noise.

Accordingly, the present disclosure describes an apparatus and method for actively measuring acoustic noise in order to manage the relationship between electrical noise and microphone array directivity. To this end, the apparatus and method of the present disclosure includes implementing one beamformer or a combination of beamformers based on the measured acoustic noise, the one beamformer or the combination of beamformers effectively accounting for electrical self-noise and directivity and providing an audio output with a high SNR. Moreover, in this way, the apparatus and method of the present disclosure allows for minimal microphone spacing within the microphone array, thereby obviating the typical balance between electrical self-noise and un-aliased bandwidth and allowing for the one beamformer or the combination of beamformers to be applied to a small form factor microphone array (e.g., smaller microphone arrays typically increase electrical self-noise, or white noise amplification, while larger arrays typically increase spatial aliasing).

Embodiments of the present disclosure optimize the balance between white noise amplification and SNR enhancement by means of a beamforming aperture (i.e. directivity) for multi-element microphone arrays.

Figure 2B:
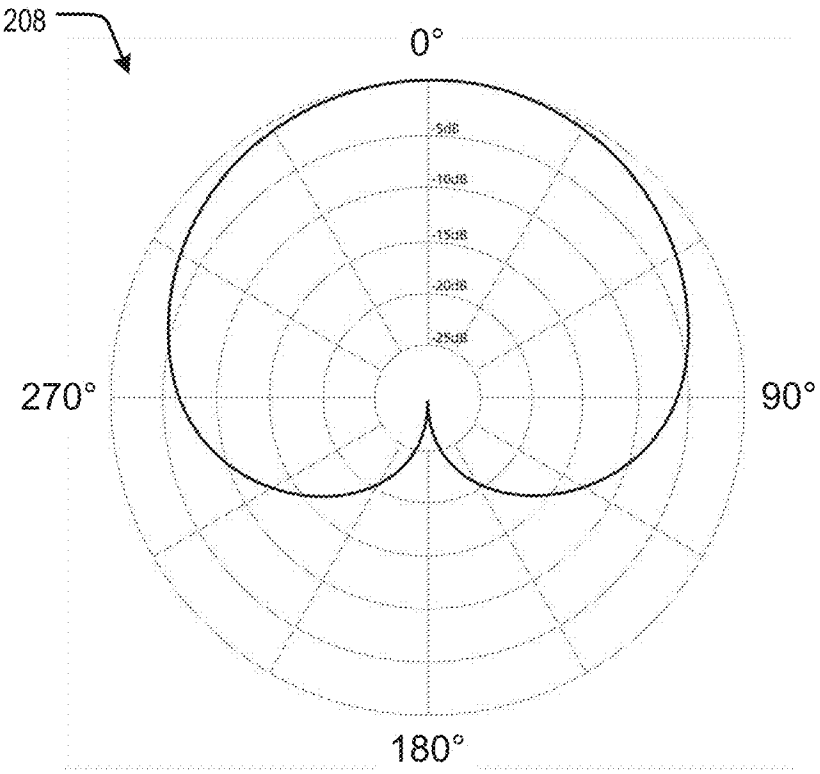
FIG. 2B is an exemplary polar pattern of a cardioid microphone.
Figure 2A:
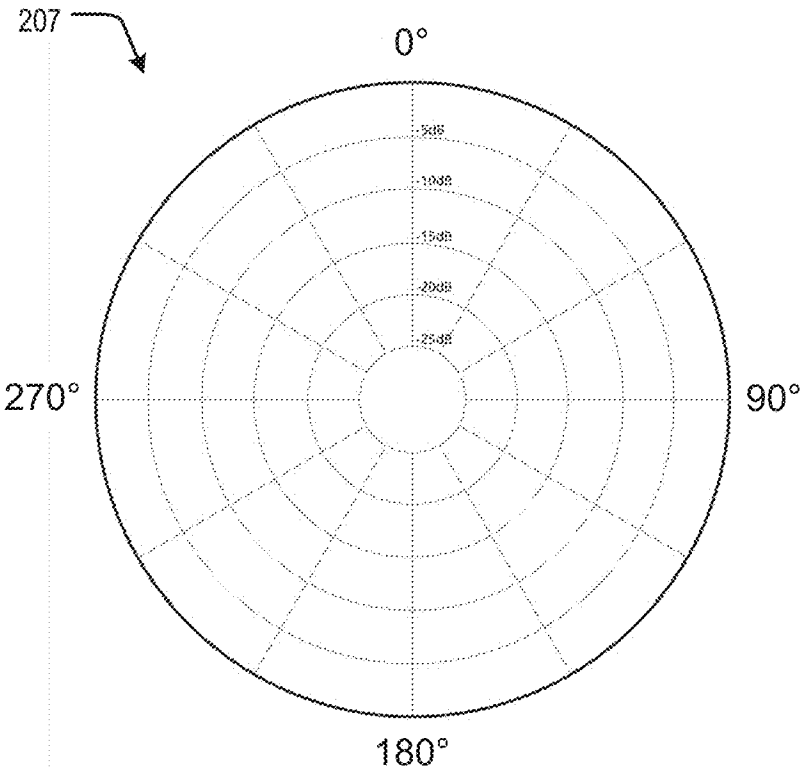
FIG. 2A is an exemplary polar pattern of an omnidirectional microphone.

Returning now to the Figures, FIG. 2A and FIG. 2B provide illustrations of exemplary polar patterns of microphones that may be employed within a microphone array of the present disclosure. FIG. 2A is an illustration of an exemplary polar pattern of an omnidirectional microphone 207, wherein the grey lines represent the polar plot area and the black lines indicate the acceptance angle of the microphone. In the case of the omnidirectional microphone 207, the acceptance angle of the microphone is 360 degrees. This allows sound to be received from all directions. Different microphones have variable acceptance angles, however, and so a microphone may be selected according to specific needs of an application. For instance, FIG. 2B is an illustration of an exemplary polar pattern of a directional microphone 208 (e.g., cardioid microphone, bidirectional microphone), wherein the grey lines represent the polar plot area and the black lines indicate the acceptance angle of the microphone. In the case of the directional microphone 208, the acceptance angle of the microphone is ~130 degrees. In this way, the directional microphone 208 allows for control of audio reception as the region outside the acceptance angle, at least, can be attenuated and, therefore, not received at the microphone. The directional microphone 208 of FIG. 2B is one of a number of directional microphones allowing for control of an acceptance angle. It can, therefore, be appreciated that the cardioid polar pattern of FIG. 2B is merely one of a variety of suitable polar patterns based on applications needs, wherein adjusting the polar pattern will allow for modulation of the acceptance angle. Such polar patterns include supercardioid, hypercardioid, bidirectional, lobar, and the like.

At present, however, omnidirectional microphone elements, such as the omnidirectional microphone of FIG. 2A, provide robust platforms upon which systems may be designed. Micro-electromechanical systems-based omnidirectional microphones, in particular, provide a robust condenser choice for circuit board level manufacturing, exhibit better tolerances for frequency response, sensitivity, phase drift, and temperature coefficients, among others.

Moreover, the polar patterns described above can be generated by implementing one or more beamformer designs within a microphone array comprised of omnidirectional microphones. In this way, acceptance angle of the microphone array can be controlled. Accordingly, the apparatus and method of the present disclosure employ, in an embodiment, beamforming strategies directed to a microphone array including a plurality of omnidirectional microphones.

Beamforming with a multi-element microphone array, as introduced above, is a signal processing technique which can be applied in order to create an 'aperture' through which sound can be permitted or blocked. In other words, sound from desirable angles may be allowed to pass through the 'aperture' while sound from undesirable angles may be blocked. A variety of beamforming approaches exist, each offering different advantages as it relates to the 'aperture', and posing different disadvantages. For instance, certain approaches introduce self-noise, or 'white noise amplification', as a disadvantage, the self-noise being purely in the electrical domain and inversely proportional to frequency. In another instance, certain approaches offer a decreased electrical noise floor but suffer from undesirable aperture and overall beamwidth (i.e. beam consistency as a function of frequency), as well as spatial aliasing. Presenting a paradox, a beamforming approach which creates the most desirable beamwidth, and a beam which is consistent across all frequencies up to the point of aliasing, also happens to result in the highest amount of electrical self-noise.

These conditions can be exaggerated when applied in the automotive environment. Owing to electrical self-noise, noise is effectively added in the lower frequencies of the beamformer output spectrum (e.g 0.1-1 kHz), a particularly troubling fact for automotive applications as the bulk of the acoustic noise density is inversely proportional to frequency. Further, this self-noise amplification mechanism is proportional to the directivity of the beam pattern and inversely proportional to the inter-element spacing of the array. Therefore, a similar type of beamformer is not usually employed with such high directivity, as it can be understood that a smaller microphone array size generates a better beam pattern with an elevated self-noise, rendering the array almost unusable in low acoustic noise situations.

The above beamformer description and shortcomings provide motivation for the apparatus and method of the present disclosure. In particular, from the above, it can be appreciated that the goal of an ideal beamformer is to create an appropriately narrow aperture to allow sounds from only certain directions to pass through, thereby increasing the overall system SNR.

Figure 3:
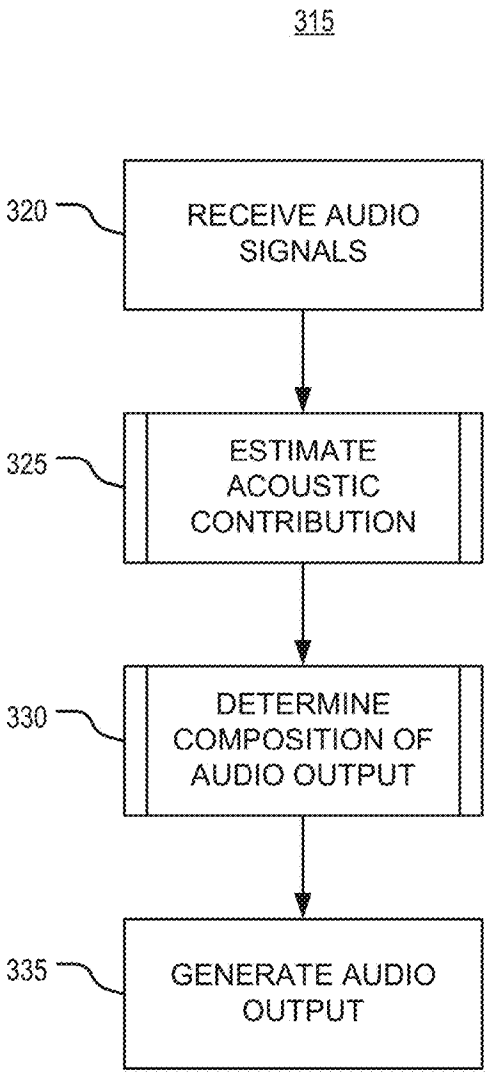
FIG. 3 is a flow diagram of a process of modulating an audio output of a microphone array, according to an exemplary embodiment of the present disclosure.

Returning now to the Figures, FIG. 3 is a flow diagram of a process describing the method of an exemplary embodiment of the present disclosure.

Process 315 of FIG. 3 describes a method of modulating an audio output of a microphone array, the method employing one or more beamformers similar to that which is described above.

At step 320 of process 315, audio signals may be received from microphones of the microphone array. The microphone array may be one of a plurality of microphone arrays positioned throughout a vehicle cabin or on an exterior of the vehicle. The microphone army may include, as described above, omnidirectional microphones. The microphone army may be a linear array or non-linear array, exemplary arrangements of which are illustrated in FIG. 8A through FIG. 8E.

At sub process 325 of process 315, an acoustic noise contribution may be estimated based on the received audio signals. The acoustic noise contribution of the sound field may be continuously estimated in order to provide a real-time measure of acoustic noise contribution to sub process 330 of process 315, wherein the estimated acoustic noise contribution is used in order to determine composition of an audio output. In an embodiment, the acoustic noise distribution is estimated independently of speech. To allow this estimation, several approaches including voice activity detectors and null talkers, described in detail with reference to FIG. 4A, FIG. 4B, FIG. 5, and FIG. 10A through FIG. 10C, may be employed.

Having estimated the acoustic noise contribution level at sub process 325 of process 315, a composition of an audio output may be determined at sub process 330 of process 315. According to acoustic noise contribution level, and in order to provide consistent output across all frequencies, one or more beamformer outputs may be combined in order to generate an optimal audio output maximizing SNR.

Introduced simply, sub process 330 of process 315 can be appreciated in view of an example including two beamformer types. Consider beamformer "A" having low directivity and, thus, low self-noise, and beamformer "B" having high directivity and, thus, higher self-noise. Using either beamformer, individually, across a range of acoustic noise contribution levels would be unwise, as the relatively high white-noise amplification of beamformer "B" would be a hindrance in a low acoustic noise environment while beamformer "A" would not have a narrow enough aperture in a high acoustic noise environment. The method of the present disclosure provides a method of blending the output of beamformer "A" and the output of beamformer "B", based on an acoustic noise field measured at a surface of a microphone capsule of the array, in order to provide an audio output that maximizes SNR across a range of acoustic noise contribution values. Accordingly, in the simplified example, if there is a low level of acoustic noise contribution, beamformer "A" is likely to dominate the combined output. If there is a medium level of acoustic noise contribution, beamformer "A" and beamformer "B" are likely to contribute equally to the combined output. If there is a high level of acoustic noise contribution, beamformer "B" is likely to dominate the combined output.

Similarly, when a low acoustic SNR is present, the combined beamformer may become more directive, providing an improvement in overall SNR, especially in low frequencies, while being impeded by an accordant increase in self-noise. The overall effect is a combined beamformer output, or audio output, which never creates more self-noise than the summation of the minimum acoustic noise contribution and the allowable contribution of self-noise to the minimum acoustic noise floor. In other words, the total amount of noise in the combined beamformer output comes from the difference between the minimum acoustic noise contribution and the summation of the noise reduction benefit of the aperture and the contribution of self-noise.

It can be appreciated that the simple, two beamformer example above can be expanded to include a plurality of beamformers, as appropriate, with considerations to processing capabilities and SNR trade-offs. Further still, the above example can be expanded to consider frequency-dependencies in formulating an optimal beamformer composition. As described above, frequency is inversely related to electrical self-noise and this must also be considered across a possible spectrum of acoustic frequencies.

The composition of the audio output determined at sub process 330 of process 315 can be used in generation of the audio output at step 335 of process 315. The audio output can be provided to one or more speakers of a vehicle, as in the case of an in-car-communication system. As the acoustic noise contribution changes in real-time, the composition of the audio output will also change as the combined beamformer is updated. In order to avoid the sound of an audible click, pop, or other type of artifact, transitions between beamformer types can be facilitated by, in an example, cross-fading gain curves. Cross-fading gain curves exhibit a tunable time constant, providing a constant change between predesigned beams that is modulated by the estimated acoustic noise contribution. Such cross-fading gain curves may vary across an acoustic frequency spectrum. In this way, as the estimated acoustic noise contribution fluctuates, a previous beamformer receives an attenuation "fade-out" profile while a subsequent beamformer receives a "fade-in" profile. The time constant of the cross-fading gain curves can be adjusted depending on the speed at which the level of the estimated acoustic noise contribution changes. For instance, the time constant may be short or long according to the rapidity at which the acoustic noise environment changes. Such time constants will be described in greater detail with reference to FIG. 10A through FIG. 10C.

Figure 4B:
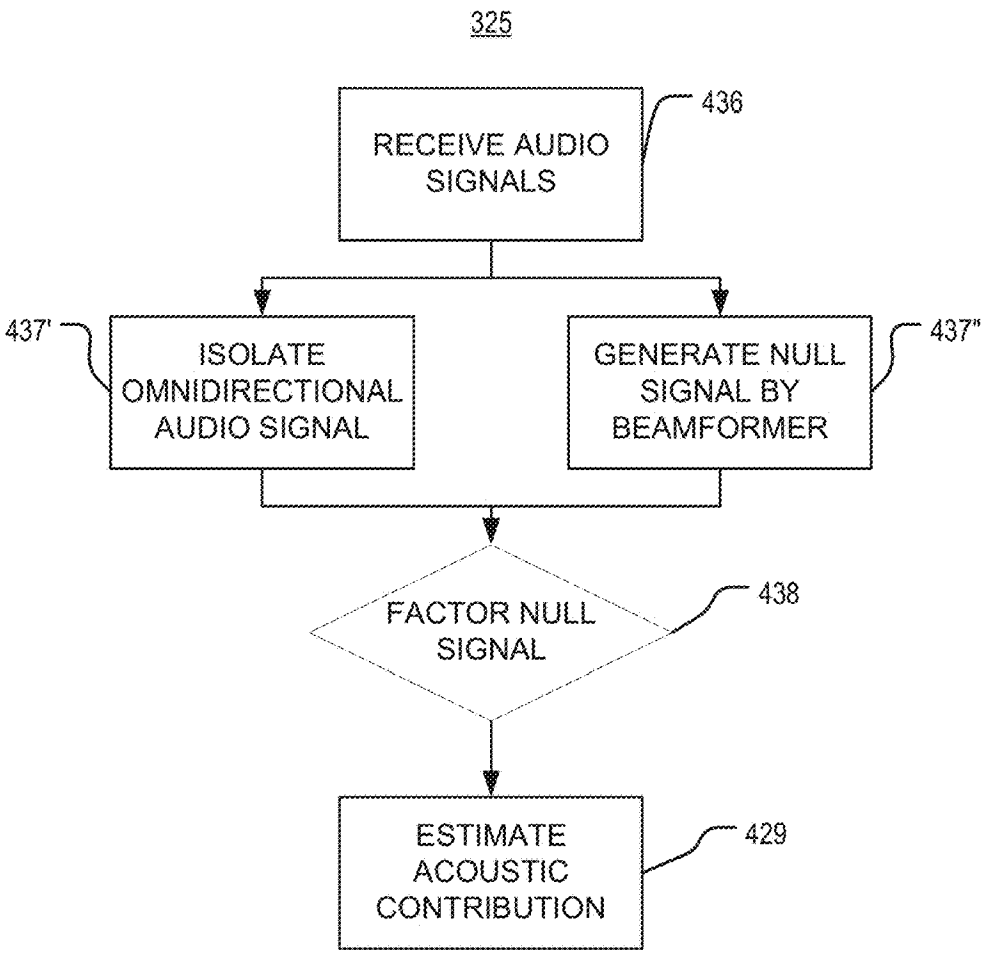
FIG. 4B is a flow diagram of a sub process of a process of modulating an audio output of a microphone array, according to an exemplary embodiment of the present disclosure.
Figure 4A:
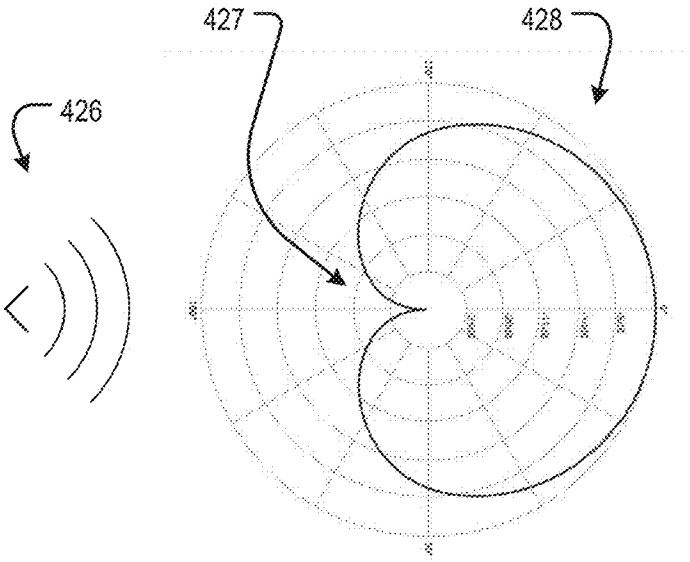
FIG. 4A is an illustration of an aspect of a sub process of a process of modulating an audio output of a microphone array, according to an exemplary embodiment of the present disclosure.
Figure 5:
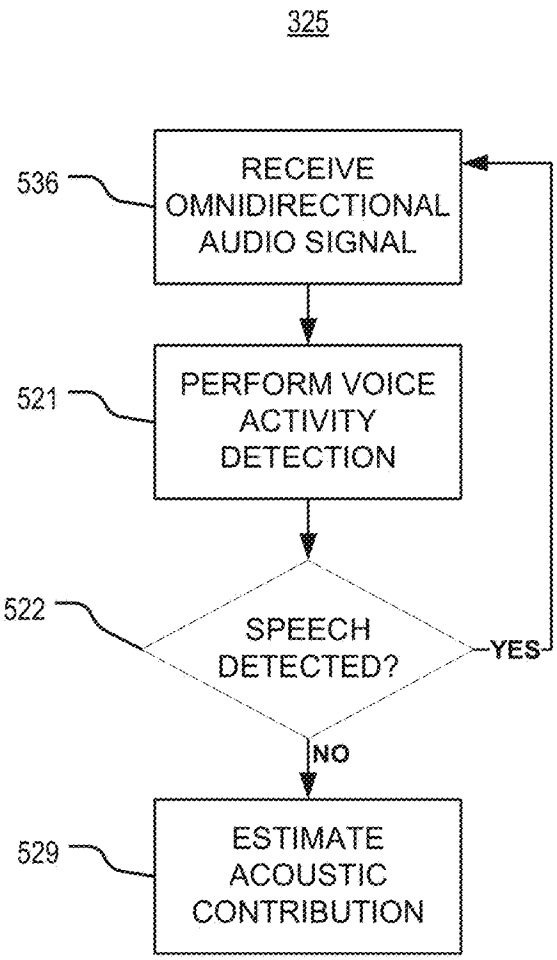
FIG. 5 is a flow diagram of a sub process of a process of modulating an audio output of a microphone array, according to an exemplary embodiment of the present disclosure.

With reference now to FIG. 4A, FIG. 4B, and FIG. 5, the acoustic noise contribution can be estimated independently of speech. To this end, it can be appreciated that a microphone array may receive, at any given time, acoustic signals generated by a variety of sources, including road noise, vehicle noise, and passenger speech. A plurality of beamformer designs may then be applied, independently and concurrently, to the acoustic signals received by the microphone array. In an embodiment, in order to isolate speech and remove it from an estimation of acoustic noise contribution, acoustic noise can be isolated from direct speech through the use of a directional beamformer applied to the received acoustic signals. The directional beamformer may generate a beam pattern similar to the polar pattern of a cardioid microphone, as shown in FIG. 4A, thereby permitting the generation of a "null talker". To this end, a null 427 of the directional beamformer may be directed toward a direction of an intended speaker 426, or origin of human speech, such that a resulting polar pattern 428 is disposed to generate an acoustic noise term capturing speech reflections and noise.

In the context of a vehicle, an audio signal generated by a microphone in the microphone array may be a summation of speech, speech reflections, and noise. It can be further appreciated that, through implementation of a directional beamformer to the microphone array, as described in FIG. 4A, an audio output generated by the directional beamformer, or designed aperture, includes speech reflections and noise or, more generally, acoustic noise.

Specifically, as described in FIG. 4B, audio signals may be received from a microphone array at step 436 of sub process 325. An unprocessed audio signal may be isolated at step 437' of sub process 325. In an example, the unprocessed audio signal may be acquired from a microphone of the microphone array closest to the human talker. Concurrently, the audio signals received at step 436 of sub process 325 may be processed to generate, at step 437" of sub process 325 a "null talker". The processing may include implementation of a particular directional beamformer. Based on the onmidirectional audio signal isolated at step 437' of sub process 325 and the "null talker" generated at step 437" of sub process 325, an estimate of a speech signal-to-noise ratio (sSNR) can be determined at step 438 of sub process 325. The sSNR determined at step 438 of sub process 325 can be the basis of the acoustic noise contribution estimated at step 429 of sub process 325 and can be provided to sub process 330 of process 315 in order to update the combined beamformer output. In this way, the output of the combined beamformer is maximized by directivity. Such approach also allows for form factor of the microphone array to be minimized according to a given number of microphones, the self-noise thereof not exceeding the allowable contribution to the overall acoustic noise minimum.

In another embodiment, and with reference now to FIG. 5, the acoustic noise contribution can be estimated independently of speech through the use of a voice activity detector. The voice activity detector can be used to isolate, as introduced above, a noise value reflective of the acoustic environment without the impact of human speech. Accordingly, at step 536 of sub process 325, an audio signal may be received from an omnidirectional microphone of the microphone array. In an example, the omnidirectional microphone may be a microphone of the microphone array that is closest to a human talker. The audio signal received from the omnidirectional microphone at step 536 of sub process 325 may be evaluated at step 521 of sub process 325 for the presence of speech. It can then be determined, at step 522 of sub process 325, if speech is present or absent in the received omnidirectional microphone audio signal. If it is determined that speech is present in the audio signal, sub process 325 returns to step 536. If, alternatively, it is determined that speech is absent from the audio signal, sub process 325 proceeds to step 529 and the audio signal received at step 536 may be used as the basis for the acoustic noise contribution estimated at step 529.

In view of the above, it can be appreciated that an ideal situation may combine the advantages of a voice activity detector and a null talker. For instance, understanding that effectiveness of a voice activity detector is inversely proportional to acoustic noise level, a combination of a null talker (i.e., directional beamformer with a null directed at a human talker) and a voice activity detector may provide a straight forward approach to isolating and estimating acoustic noise contribution. This combination may result in a blended detector output, wherein a voice activity detector is used at lower acoustic noise contribution levels and a null talker is used at higher acoustic noise contribution levels, to decide the fate of a combined beamformer mixture composition, as will be described below. For instance, the above-described detection and estimation may inform the determination of when to update the combined beamformer mixture composition and by what ratios.

Having estimated the acoustic noise contribution at sub process 325, process 315 may proceed to sub process 330 wherein the estimated acoustic noise contribution can be used to determine a composition of beamformer outputs. The composition of beamformer outputs, as described in the flow diagram of FIG. 6, can be based on total noise values determined for each of a plurality of beamformers according to, in part, the estimated acoustic noise contribution.

Figure 6:
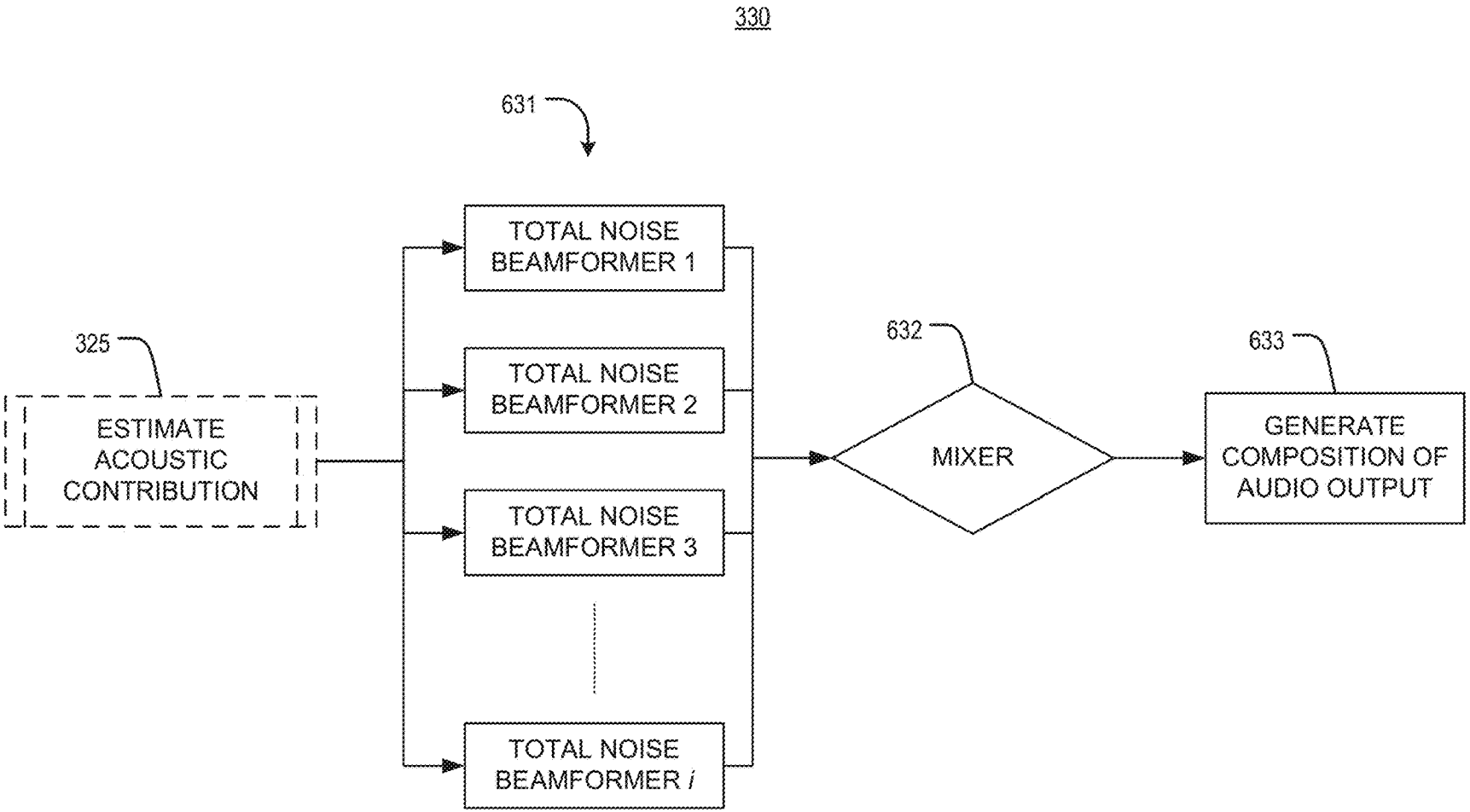
FIG. 6 is a flow diagram of a sub process of a process of modulating an audio output of a microphone array, according to an exemplary embodiment of the present disclosure.

With reference to FIG. 6, the acoustic noise contribution estimated at sub process 325 of process 315 can be used in sub process 330 of process 315 to determine and generate a composition of the audio output of the microphone array. Having received the estimated acoustic noise contribution, a total noise value for each of a plurality of beamformers can be determined at step 631 of sub process 330. In an example, and as shown with respect to FIG. 9 through FIG. 10C, the plurality of beamformers may include three or more beamformers. It can be appreciated, of course, that the number of beamformers is based on the needs of an application and is not limiting, as the method of the present disclosure can be consistently implemented independently of a number of beamformers of a plurality of beamformers which may include Beamformer 1, Beamformer 2, Beamformer 3, . . . , Beamformer i.

The total noise value ($N_T(\omega)$) of each of the plurality of beamformers determined at step 631 of sub process 330 can be considered simply as a combination of contributions from acoustic noise ($N_a$), described above with reference to FIG. 4A through FIG. 5, and electrical self-noise ($N_e$). This relationship, for a given frequency ($\omega$) or frequency band, is described in Equation (1).

$$N_T(\omega)=(N_e(\omega))^2+(N_a(\omega))^2 \quad (1)$$

A more complete understanding can be developed with consideration to additional factors impacting the total noise value of each beamformer. For instance, $N_a$ may be reduced by a directivity index (DI) of a beamformer while $N_e$ can be amplified by a post filter ($H_p$) of a beamformer and the number of microphones of the microphone array, as defined by their statistical combinatory principle ($M_e$). Equation (2) builds on Equation (1), and is described below.

$$N_T(\omega) = \sqrt{(H_p(\omega)M_eN_e(\omega))^2 + \left(\frac{N_a(\omega)}{\sqrt{DI(\omega)}}\right)^2} \tag{2}$$

Focusing on the electrical self-noise term ($N_e$), electrical self-noise is a type of noise that may be caused by mechanisms inside electrical components such as thermal noise (e.g., temperature fluctuations), flicker noise, shot noise, transit noise, burst noise, and the like. These mechanisms are independent of the acoustic domain and, as such, electrical noise from each microphone of a plurality of microphones is uncorrelated. Electrical noise from each microphone is, however, based on laboratory measurements of reference microphones that define the electrical self-noise term of each microphone across all acoustic noise environments. The total electrical self-noise contribution from these mechanisms is a summation of self-noise through the entirety of circuitry used in a system and results in the total electrical self-noise of the microphone array. To this end, and as demonstrated by Equation (2), beamforming balances improved directivity with electrical self-noise amplification.

This balance can be determined, in part, by the order of a microphone array structure (e.g. how many layers there are), which determines the post filter of the beamformer. Electrical self-noise that exist prior to the post filter can then be multiplied by the spectrum of the post filter. This approach, in principle, is how low frequencies of the electrical self-noise term become amplified in the case of differential arrays. In the case of delay and sum beamformers, however, the post filter is equal to 1/M, where M is the number of microphones used and electrical self-noise at the output is reduced. In this way, the number of utilized microphones of a microphone array adds a noise multiplier into the total noise equation. In an example of a two microphone differential array, the noise multiplier is $\sqrt{2}$. In an example of a three microphone, $2^{nd}$ order differential array, the noise multiplier is $\sqrt{6}$. Moreover, and as a comparison, in an example of a three microphone delay and sum beamformer, the noise multiplier is $\sqrt{3}$.

Since the electrical self-noise term for each microphone in a microphone array is uncorrelated, the total electrical self-noise term of the microphone array can be multiplied by a factor, $M_e$, described in Equation (3).

$$M_e = \Pi_{l=1}^{L}\sqrt{M_l} \tag{3}$$

Equation (3) assumes that a beamformer can be written in layers, as introduced above, where each layer contains a certain number of effective input signals, M. For example, in a second order differential array, there are two effective layers. The first layer may contain three input signals while the second layer contains two input signals (i.e., the results from first layer). Therefore, the number of input signals is described as $M=\sqrt{6}$. Comparatively, a delay and sum beamformer using three microphones would have an effective M value of $\sqrt{3}$. In any event, the electrical self-noise term which is subsequently followed by the post filter response, and the total noise value of each beamformer, including the layers and/or order of the microphone array, can be written via root-mean-square process, wherein uncorrelated signals are additive, as $$N_T(\omega) = \sqrt{\left(H_p(\omega)\prod_{l=1}^{L}\sqrt{M_l}\,N_e(\omega)\right)^2 + \left(\frac{N_a(\omega)}{\sqrt{DI(\omega)}}\right)^2} \tag{4}$$

In Equation (4), $N_T$ is the total noise term, c is the frequency term, $H_p$ is the post filter of the beamformer, L is the number of layers in the beamformer (i.e., order for differential), M is the number of input signals in the design of each of the layers of the beamformer, $N_e$ is the electrical self-noise of a single omnidirectional microphone within the army, $N_a$ is the acoustic noise contribution, and DI is the directivity index of the beamformer.

Equation (4) can be used at step 631 of sub process 330 to determine the total noise value for each beamformer of the plurality of beamformers. In order to combine multiple beamformers into a single beamformer via the mixer at step 632 of sub process 330, the total noise value from each beamformer can be crossover filter weight summed, the result being a combined total noise value. The combined total noise value can be written as $$N_T(\omega)=N_{T,0}(\omega)H_0(\omega)+N_{t,1}(\omega)H_1(\omega)+N_{T,2}(\omega)H_2(\omega)+\ldots+N_{T,i}(\omega)H_i(\omega) \tag{5}$$

where $N_t$ is the combined total noise value, $N_{t,0}$ is the total noise value determined for beamformer 0, $H_0$ is the filter transfer function applied to beamformer 0, $N_{t,1}$ is the total noise value determined for beamformer 1, $H_1$ is the filter transfer function applied to beamformer 1, $N_{t,2}$ is the total noise value determined for beamformer 2, $H_2$ is the filter transfer function applied to beamformer 2, $N_{t,i}$ is the total noise value determined for beamformer i, and $H_i$ is the filter transfer function applied to beamformer i. Directivity of the combined beamformer can be controlled by design of the polar response of the combined beamformers and by exploiting specific benefits of one or more beamformers in a particular frequency range.

The mixer, at step 632 of sub process 330, may modulate the audio output of the microphone array by adjusting contribution levels from different beamformers of step 631 based on the acoustic noise contribution estimated at sub process 325. In this way, the mixer can maximize the SNR of the audio output modulated by the combination beamformer. Such functionality may be performed concurrently or separately. In an embodiment, the adjusting contribution levels of each of the plurality of beamformers can be performed ratio-metrically, at a given frequency, according to the estimated acoustic noise contribution and/or a total noise contribution of each beamformer design. In an embodiment, the adjusting contribution levels of each of the plurality of beamformers can be defined mathematically, at a given frequency, according to an acoustic noise contribution level and/or a total noise contribution of each beamformer design. In an example, the adjustment may be based on a step-wise function defining the relationship between composition of the modulated audio output of the microphone array and the estimated acoustic noise contribution. In another example, the adjustment may be based on a logarithmic function defining the relationship between composition of the modulated audio output of the microphone array and the estimated acoustic noise contribution. In view of the above, it can be appreciated that a variety of approaches to defining a relationship between beamformer composition, acoustic noise contribution, and/or total noise contribution for each beamformer design, at a given frequency, can be developed without deviating from the approach described herein.

Figure 7:
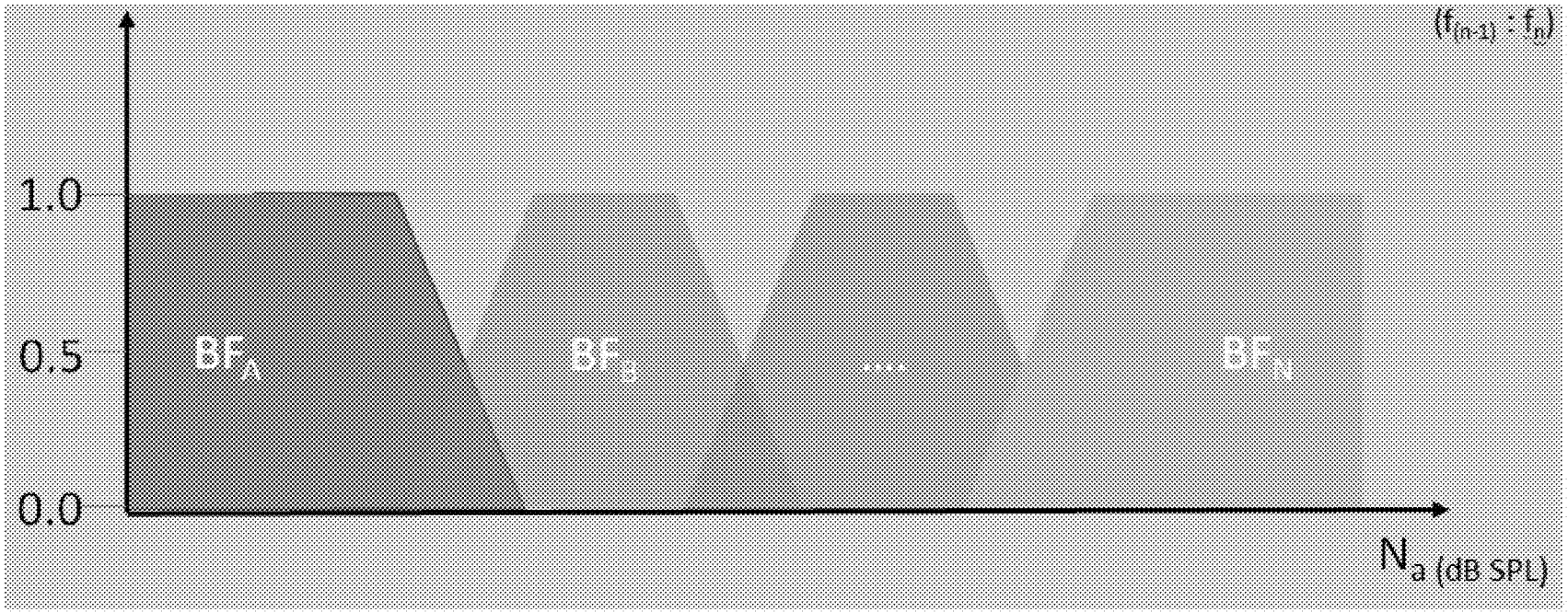
FIG. 7 is a graphical illustration of a beamforming composition at a given frequency, according to an exemplary embodiment of the present disclosure.

For instance, with reference to FIG. 7, a weight value may be assigned to each beamformer design at a given frequency band and as a function of acoustic noise. As in FIG. 7, wherein the given frequency is a frequency band between $f_{n-1}$ and $f_n$, each beamformer design may be assigned a weighted value between 0 and 1 as a function of the estimated acoustic noise. Appreciating that each beamformer design is appropriate at different volumes of estimated acoustic noise, and understanding that a governed time constant (dB/sec limiter) ensures smooth crossfades between beamformer designs, a high-fidelity modulated audio output can be ensured at the given frequency and across the spectrum of estimated acoustic noise.

In an embodiment, the weighted values of the beamformer designs shown in FIG. 7 may be accessed via a look up table upon estimation of the acoustic noise term, thus allowing the composition of the audio output to be known in real-time.

Returning now to FIG. 6, the composition determined at step 632 of sub process 330 may be generated as an audio output at step 633 of sub process 330. In other words, and referring again to FIG. 3, the composition of the audio output determined at sub process 330 of process 315 may be generated as a modulated audio output at step 335 of process 315.

Referring now to FIG. 8A through FIG. 8E, the microphone array may have a variety of structural arrangements with consideration to balancing electrical self-noise and beamwidth. According to an embodiment of the present disclosure, such arrangements include a linear arrangement 811, as in FIG. 8A through FIG. 8D, or a non-linear array arrangement 812, as in FIG. 8E.

Figure 8D:
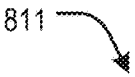
FIG. 8D is an illustration of an arrangement of a microphone array, according to an exemplary embodiment of the present disclosure.
Figure 8D:
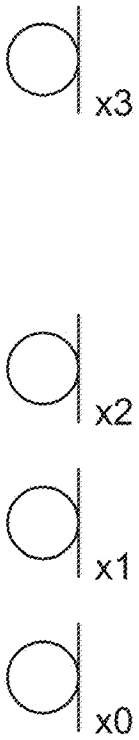
Figure 8C:
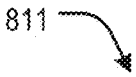
FIG. 8C is an illustration of an arrangement of a microphone array, according to an exemplary embodiment of the present disclosure.
Figure 8C:
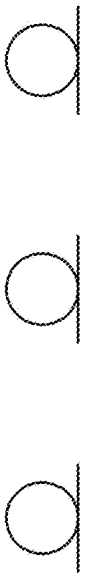
Figure 8B:
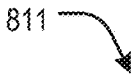
FIG. 8B is an illustration of an arrangement of a microphone array, according to an exemplary embodiment of the present disclosure.
Figure 8B:
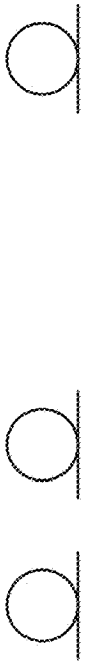
Figure 8A:
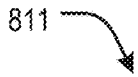
FIG. 8A is an illustration of an arrangement of a microphone array, according to an exemplary embodiment of the present disclosure.
Figure 8A:
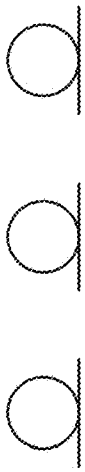

In an exemplary embodiment, a microphone array 811 may include four microphones (x0, x1, x2, and x3) located in a straight line, as in FIG. 8D. A distance between each of x0, x1, and x2 may be equal, while a distance between x0 and x2 may be similar to a distance between x2 and x3. Signals output from x0, x1, and x2 may be used for high frequency acoustics, signals output from x0, x2, and x3 may be used for mid frequency acoustics, and signals output from x0 and x3 may be use for low frequency acoustics.

Figure 8E:
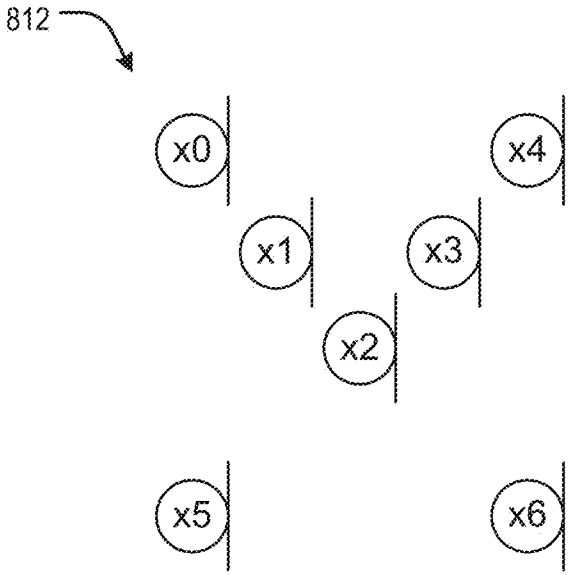
FIG. 8E is an illustration of an arrangement of a microphone array, according to an exemplary embodiment of the present disclosure.

In an exemplary embodiment, a microphone array 812 may include seven microphones (x0, x1, x2, x3, x4, x5, and x6) arranged diagonally, as in FIG. 8E. Microphone x0, x1, x2, and x6 may be arranged along a first diagonal while microphone x5, x2, x3, and x4 are arranged along a second diagonal, the diagonals intersecting at x2.

Figure 9:
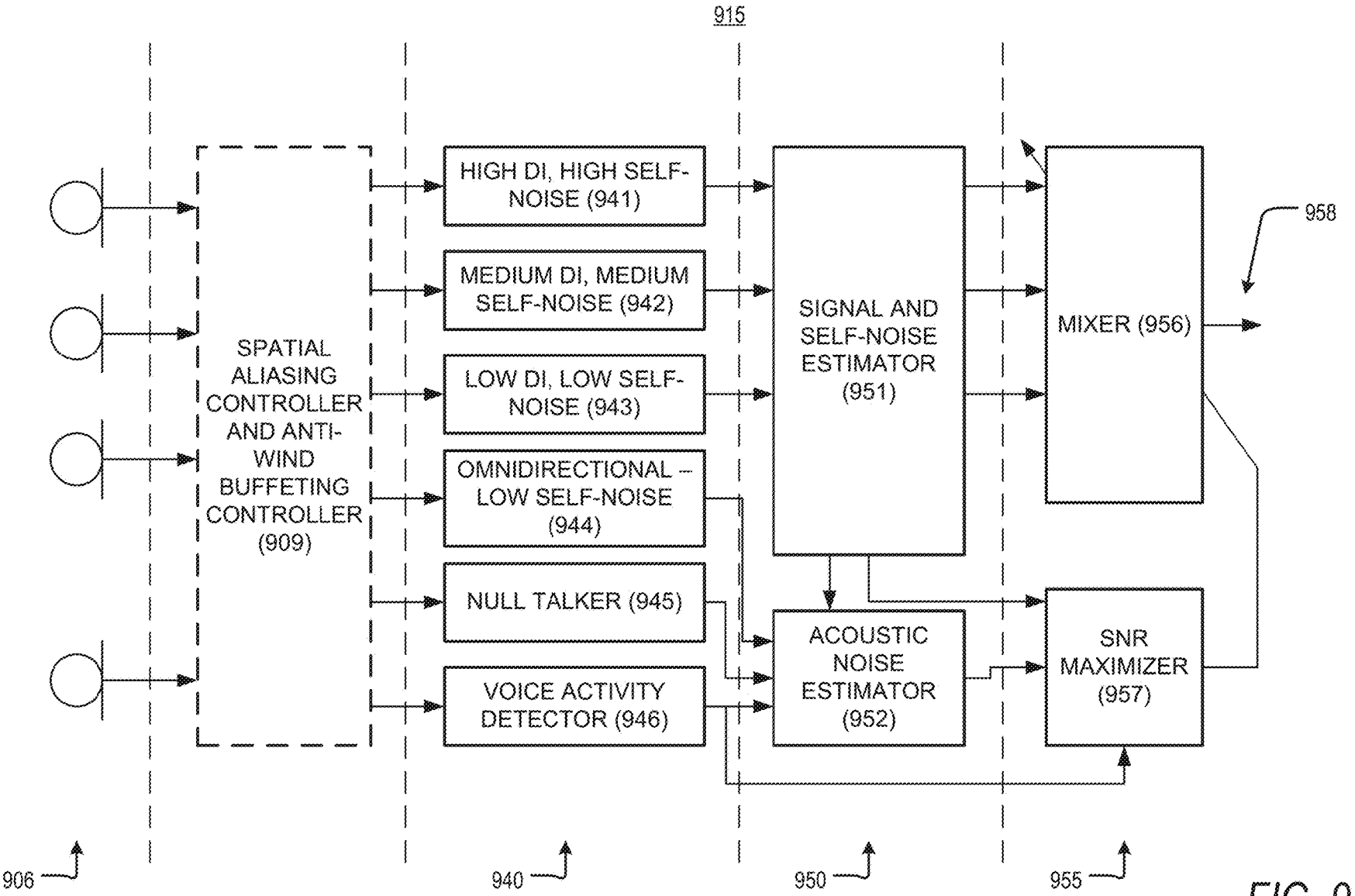
FIG. 9 is a low-level flow diagram of a process of modulating an audio output of a microphone array, according to an exemplary embodiment of the present disclosure.

The apparatus and method of the present disclosure, as introduced above with reference to FIG. 3 through FIG. 6, can be implemented within an exemplary embodiment shown in FIG. 9. FIG. 9 is a low-level flow diagram of the process of modulating an audio output of a microphone array, as described above and according to an exemplary embodiment of the present disclosure. The process described in FIG. 9, as is also the case for that which is described with reference to FIG. 3 through FIG. 6, can be performed by processing circuitry of an ECU of a vehicle (see FIG. 1). The processing circuitry of the ECU of the vehicle may be a digital signal processor, in an example. Such an ECU will be described later with reference to FIG. 11.

Initially, an audio signal received at each of a plurality of omnidirectional microphones 905 of a microphone array can be sent via an audio input controller to, for example, a digital signal processor of an ECU of a vehicle. Optionally, a spatial aliasing controller and wind buffeting controller 909 can be applied in order to resolve the received audio signals. The received audio signals can then be processed according to a plurality of beamformers and voice activity detection modalities 940. The plurality of beamformers and voice activity detection modalities 940 can include a high DI, high self-noise beamformer 941, a medium DI, medium self-noise beamformer 942, and a low DI, low self-noise beamformer 943. In an embodiment, each of the beamformers 941, 942, 943 may be frequency-dependent and may include one or more beamformers according to frequency. The plurality of beamformers and voice activity detection modalities 940 can be two voice activity detection modalities such as, as a first modality, an omnidirectional, low self-noise microphone 944 and a null talker 945, as described with reference to FIG. 4A and FIG. 4B, and, as a second modality, a voice activity detector 946, as described with reference to FIG. 5. Noise and signal estimates 950 may be output from the plurality of beamformers and voice activity detection modalities 940. An output of each of the beamformers and a self-noise estimate can be provided, via a signal and self-noise estimator 951, to an acoustic noise estimator 952 and to an SNR maximizer 957. The output of the voice activity detection modalities can be provided, concurrently, to the acoustic noise estimator 952. In an embodiment, wherein a directional beamformer is deployed, an output of the null talker 945 or the voice activity detector 946 can be provided directly to the SNR maximizer 957. The acoustic noise contribution estimated by the acoustic noise estimator 952 can be provided to the SNR maximizer 957. Having received the estimated acoustic noise contribution from the acoustic noise estimator 952 and the beamformer signals and self-noise estimate from the signal and self-noise estimator 951, a total noise value for each beamformer 941, 942, 943 can be generated based on the estimated acoustic noise. Accordingly, and in order to maximize the SNR of a combined beamformer output, a total noise value is minimized and the composition thereof is utilized by a mixer 956 to combine the outputs of each of the beamformers 941, 942, 943 as a combined audio output 958 for a given frequency.

Figure 10A:
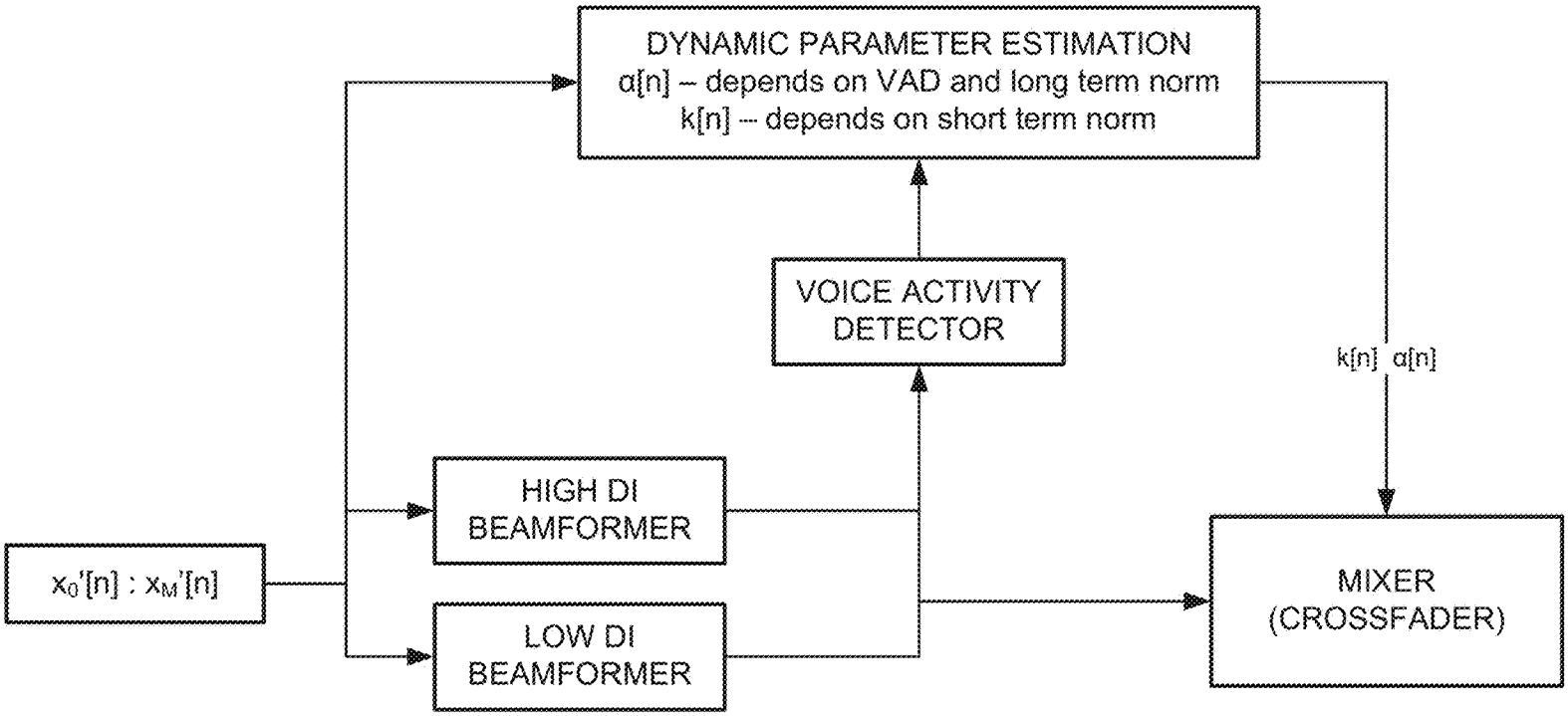
FIG. 10A is a high-level flow diagram of a process of modulating an audio output of a microphone array, according to exemplary embodiment of the present disclosure.
Figure 10B:
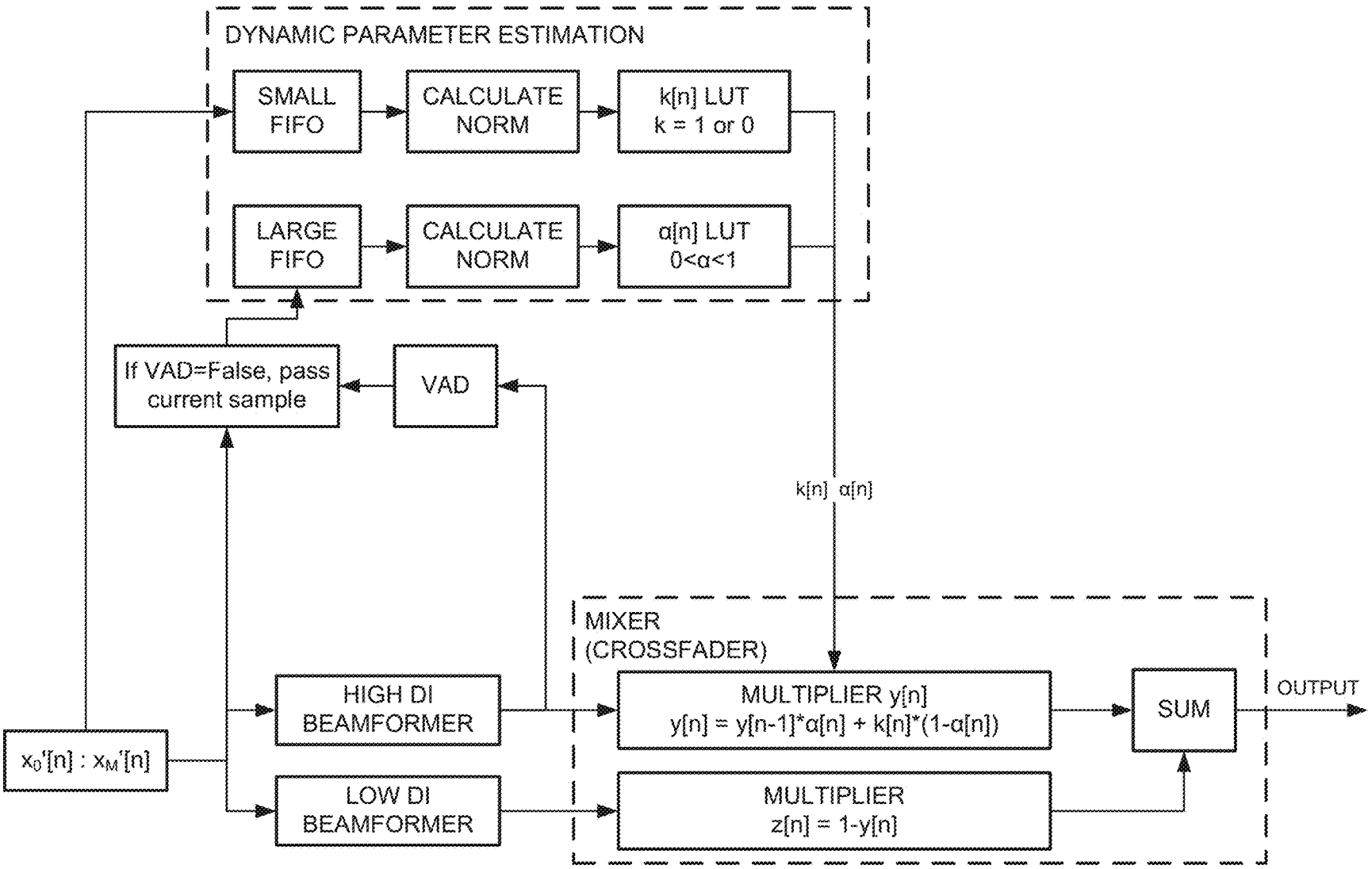
FIG. 10B is a low-level flow diagram of a process of modulating an audio output of a microphone array, according to an exemplary embodiment of the present disclosure.
Figure 10C:
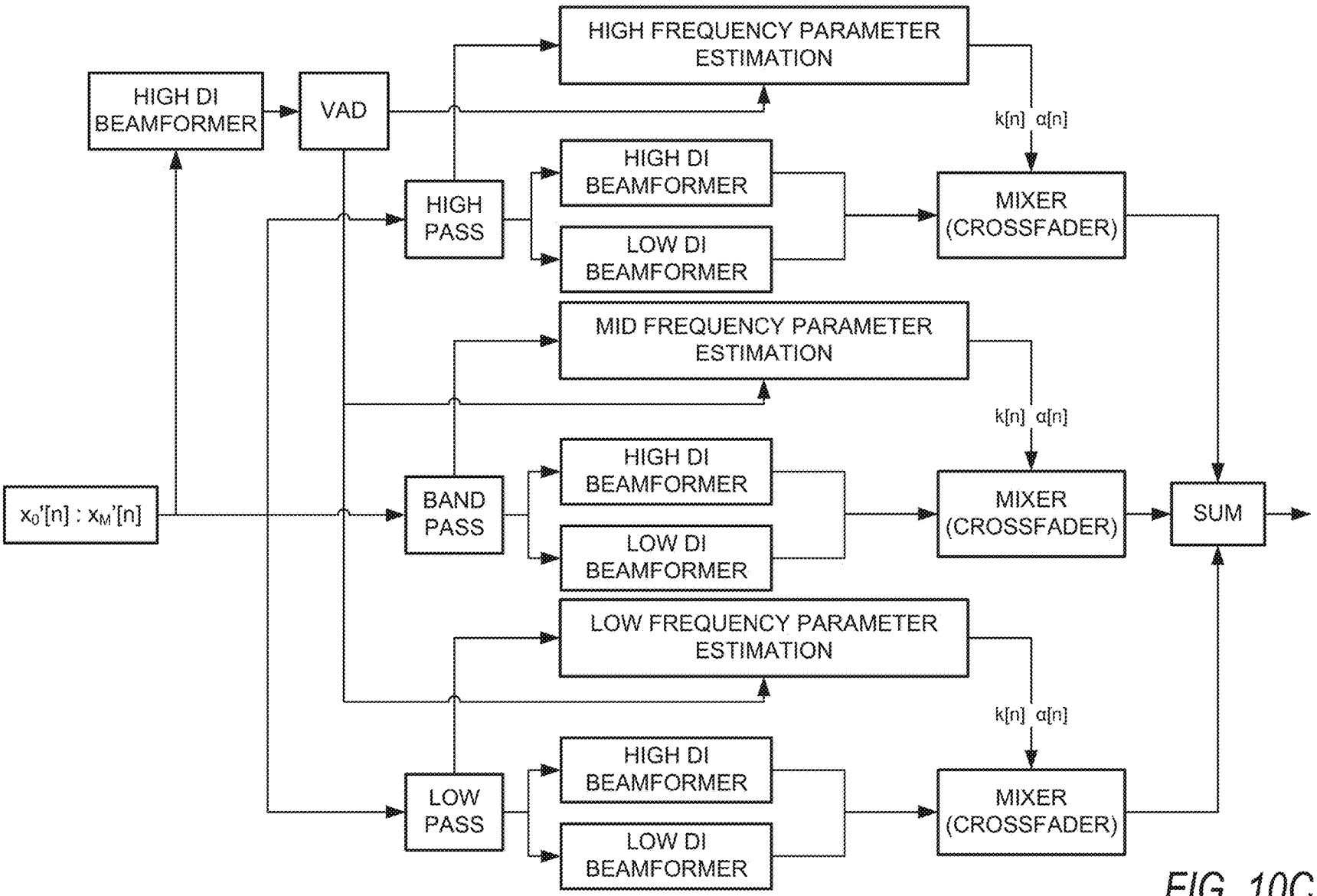
FIG. 10C is a flow diagram of a process of modulating an audio output of a microphone array, according to an exemplary embodiment of the present disclosure.

Further to the above, FIG. 10A through FIG. 10C describe, holistically, combination of the beamformer outputs by the mixer 956 of FIG. 9. FIG. 10A illustrates a simplified block diagram of a system for modulating an audio output of a microphone array. Beginning from the left side of FIG. 10A, signals generated at microphones $x_0'[n]$ through $x_M'[n]$ may be passed to a dynamic parameter estimation block and, concurrently, two or more beamformers that are selected in order to balance directivity and self-noise. In an embodiment, the two or more beamformers may be a high DI beamformer and a low DI beamformer. Beamforming is performed, or calculated, concurrently for every sample of [n] at all times. The output of each beamformer is sent to a voice activity detector (VAD) and to a mixer, or crossfader, which is responsible for blending between the outputs of the beamformers based on the parameters $\alpha[n]$ and k[n] determined during estimation of the dynamic parameters. In an embodiment, values of $\alpha[n]$, which depends on the VAD and a long term norm, and k[n], which depends on a short term norm, may be estimated in real-time.

The primary function of the dynamic parameter estimation block is to inform the crossfader when, and how quickly, to mix, or fade, between each of the beamformer outputs. To this end, the dynamic parameter estimation block processes statistics from each of the output signals from microphones $x_0'[n]$ through $x_M'[n]$. The statistics include, among others, calculating a real-time value estimate of the acoustic sound pressure level (dB SPL) of the acoustic noise captured at each microphone. This value may be updated for every incoming time sample, if and only if the VAD indicates speech is not present for the incoming time sample.

Statistics (e.g. "norm") of the real-time acoustic noise (e.g. speech and noise) may be calculated and updated for each incoming time sample. A look up table (LUT) may be used to map each of these statistics onto a separate control variable (e.g. $\alpha[n]$ and $k[n]$) which instructs the mixer on how to apply specific gain per sample [n] to each of the beamformer outputs. In an embodiment, LUTs are associated with a specific frequency band and may be designed through careful study and sound quality assessment tunings, an example of which is shown in FIG. 7. Tuning of each LUT determines function of the system in a real world environment.

FIG. 10B demonstrates a low level flow diagram of the exemplary arrangement of FIG. 10A. As shown in FIG. 10B, statistics, or norms, of the acoustic noise estimate, excluding speech, and the acoustic noise estimate, including speech, are based on a large buffer and a small buffer, respectively. Each of the large buffer and the small buffer may be a first in first out (FIFO) buffer, or an equivalent thereof.

In an embodiment, the calculated norm (e.g. Euclidian L2-Norm, root mean square, etc.) of the small FIFO buffer can be used to reflect a fast changing value of the estimated acoustic noise. This fast changing value can be mapped onto a variable k[n], which may be binary. For instance, when the calculated norm of the small FIFO buffer indicates the estimated acoustic noise is above a certain threshold, then k=1. At all other times, k=0.

In an embodiment, the calculated norm (e.g. Euclidian L2-Norm, root mean square, etc.) of the large FIFO buffer only updates in the absence of speech, or when the VAD is equal to false, meaning that there is no voice activity present. In this way, acoustic noise excluding speech contributions can be estimated. Estimating acoustic noise in this way captures slow changing phenomena of the real-world and produces a value which can be mapped onto a slow-changing variable $\alpha[n]$. A speed of change for this value may be dependent upon a length of the FIFO buffer used, but could also be implemented by other means such as a rectifier or low pass filter, wherein a speed of change of the variable depends on a design order and frequency of the low pass filter.

It can be appreciated that, in this way, the binary variable k acts to instruct the mixer to switch to modulate between beamformer outputs. Understanding that k does not merely switch one beamformer output on and the other beamformer output off; k acts to instruct the mixer to apply a unique gain for each incoming beamformer sample, as governed by a given formula. As in FIG. 10B, and repeated here, the formula, in an example, is $$y[n]=y[n-1]*\alpha[n]+k[n]*(1-\alpha[n])$$

wherein k[n] serves a switch to instruct the mixer to (1) mix beamformer outputs or to (2) not mix beamformer outputs. The formula also accounts for the mapped value of the estimated acoustic noise excluding speech (i.e. $0<\alpha[n]<1$), which limits the speed at which the mixer is able to, based on k[n], mix beamformer outputs.

Effectively, if the acoustic noise is estimated to be large, then a signal from a high DI beamformer will be favored and not effected by k[n]. If the acoustic noise is estimated to be small, then short term acoustic energy (e.g. speech) will be sufficient to modulate k[n]. Thus, since $\alpha[n]$ will be low valued, such short term events will cause the system to blend quickly between the signal from the high DI beamformer and a signal from a low DI beamformer. This is useful to, for instance, reduce reverberations in the vehicle cabin during low acoustic noise moments, while simultaneously presenting very low electrical self-noise when there are moments of soft speech and/or quiet cabins. In the case of this simple (and practical) example, the signal from the high DI beamformer can be multiplied by y[n], and the signal from the low DI beamformer can be multiplied by z[n]. The two resulting, multiplied signals can then simply be summed together, which is permitted since y[n] is bounded between 0 and 1.

The descriptions of FIG. 10A and FIG. 10B will now be further explained with reference to non-limiting exemplary scenarios. In each scenario described below, a desired signal (e.g. speech from a driver) and an undesired signal(s) (e.g., concur-ent passenger speech) will be considered.

It can be appreciated that speech energy leaving a mouth of a talker radiates mostly at a spherical and/or hemispherical wave front, depending on frequency thereof. This speech energy may follow many paths, including a direct path (i.e. desirable path) between mouth and microphone and an indirect, or reflected, path (i.e. undesirable path) which accounts for all of the surfaces the wave front contacts before arriving at the microphone. In this way, there are an infinite number of reflected paths while there is only one direct path.

In a first example, speech of a driver of a vehicle may be captured by a microphone array while the vehicle is moving quickly (e.g 70 miles per hour). Accordingly, in view of the above Figures, a high DI beamformer is desired in order to capture the direct speech path while minimizing the reflected paths. Also, in this way, the high DI beamformer acts in a way to 'null' a majority of ambient noise generated by, for instance, the engine, the heating cooling, and ventilation system, the road, wind, and competing talkers. From the present disclosure, it can be appreciated that, while the high DI beamformer also exhibits a higher self-noise, the benefits of noise isolation are worthwhile in view of the total noise estimation that can be calculated in real-time. Returning to FIG. 10A through FIG. 10C, and in view of the first example, the value of k[n] would, predominantly, be one, as the acoustic noise level is substantially above the threshold the majority of time. Given the increased acoustic noise level, the value of $\alpha[n]$ would be large (e.g $>0.95$), thereby favoring the high DI beamformer. Accordingly, as observed in the mixer of FIG. 10B, the value of y[n] would ramp with acoustic noise level to be very close to one and, with increasing acoustic noise, would be allowed to change more slowly. Conversely, in order for the value y[n], or the gain value, to change more quickly, $\alpha[n]$, and therefore the acoustic noise level, would need to be lower.

In a second example, a parked vehicle with the engine off but still capturing speech from a driver is considered. In this example, $\alpha[n]$ is understandably lower than that of the first example (i.e. $<<0.95$) and the value of k[n] rapidly fluctuates between "1" with every captured syllable and "0" when the energy of the syllable falls below a threshold.

In rapidly adjusting the value of k[n], the dynamic parameter estimation block tells the mixer that new information is more important than old information. This means the mixer will attempt to switch between the beamformer designs quickly in accordance with the value of k[n]. During speech in this environment, the rapid modulation of the beamformer composition, when acoustic noise is loud enough to trigger the k[n], allows for considerable reduction in speech reflection paths. Moreover, when speech is not present, a lower DI beamformer may be fully engaged, thereby substantially reducing electrical self-noise of the microphone array. This gives the impression of a higher signal to noise ratio in low background noise scenarios.

The concepts shown in FIG. 10A and FIG. 10B are expanded to perform uniquely across several frequency bands, as shown in FIG. 10C. As in FIG. 10C, there may be three frequency bands. In each frequency band, unique statistics are determined in order to govern k[n] and $\alpha$[n]. A VAD operates according to signal captured from a high DI beamformer, as in the earlier description, and services each FIFO buffer within the acoustic noise estimation of each dynamic parameter estimation block.

Expanding the framework of FIG. 10A and FIG. 10B to multiple frequency bands allows for optimization of the tradeoff between self-noise and directivity, which depends on how much acoustic noise is estimated in each of the multiple frequency bands. HVAC systems, for instance, in addition to certain other vehicle subsystems, generate acoustic noise with non-flat spectral content. In other words, acoustic noise generated by these sources can be concentrated into select frequency bands. In fact, a simplified version of the example of FIG. 9, wherein frequency bands are not considered, may be suboptimal in the present example as it would be ignorant to additional information about the statistics of each of the several frequency bands. By considering the statistics of each frequency band, however, optimal-, frequency-dependent beamformer blends can be designed.

This can be further appreciated when considering high DI beamformers are best when designed in specific frequency bins. A high DI beamformer may not perform well, concurrently, at high frequencies and low frequencies. Therefore, it may be necessary to blend output signals from close-spaced microphone capsules, designed for high frequency, high DI beamformer designs, with output signals from wide-spaced microphone capsules designed to accommodate lower frequencies.

Hence, it may be advantageous to split the beamforming function into several frequency bands, whereby efficiency of design would also suggest incorporation of beam-blending in each frequency band to achieve a scaled system. The result of this frequency-dependent blending may provide optimal tradeoff between self-noise and directivity.

Returning to FIG. 10C, it can be appreciated that a subset of the microphone output signals may be used for each of the frequency bands. As an example, a few of the closely spaced microphone signals may be used for the higher frequencies and progressively wider spaced microphones may be used for the mid frequencies and the low frequencies, respectively.

Figure 11:
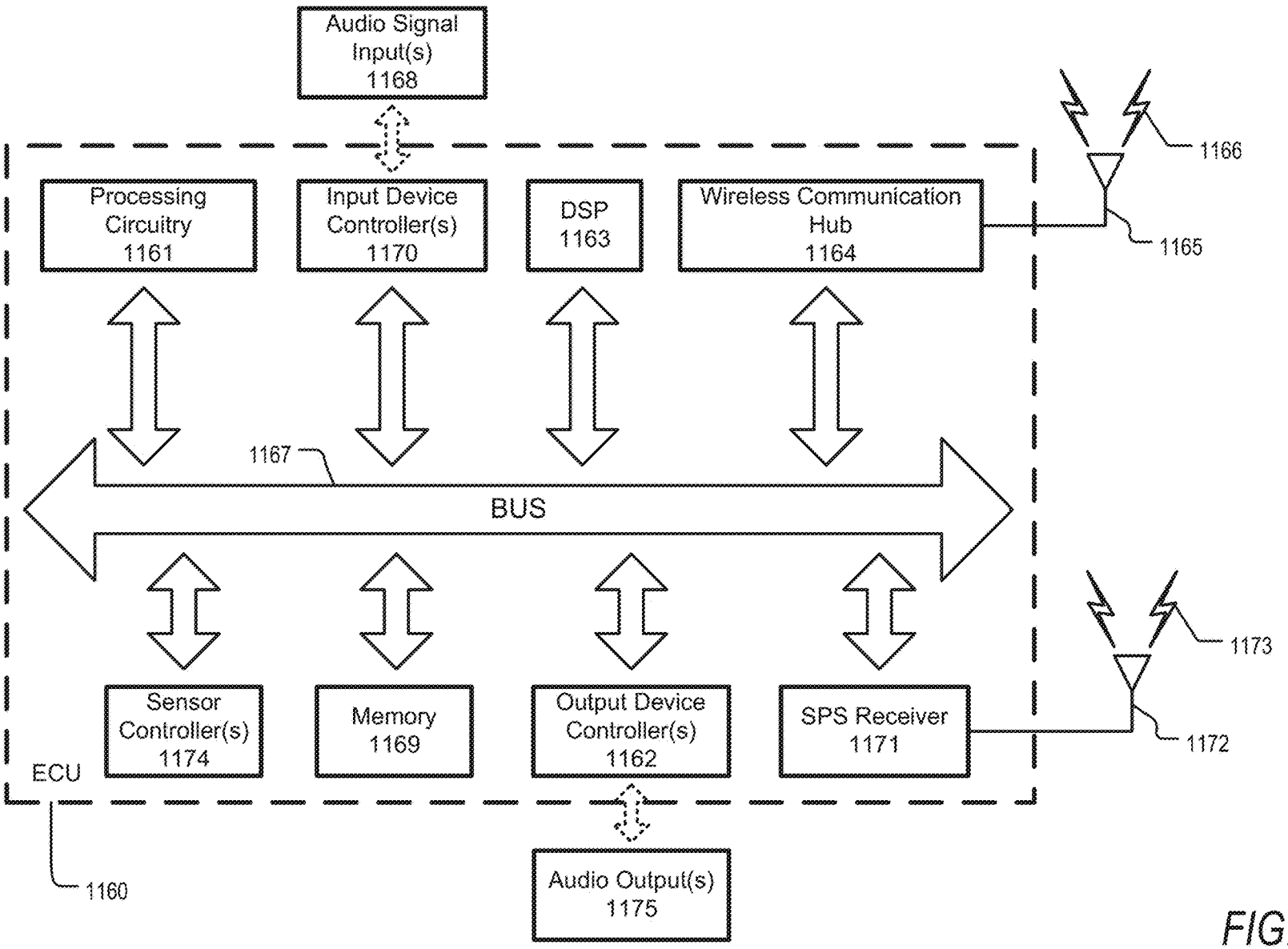
FIG. 11 is a schematic of a hardware configuration of a vehicle employing an in-car communication system, according to an exemplary embodiment of the present disclosure.

The method of the present disclosure, as described above, can be implemented in context of an ECU of a vehicle. Accordingly, FIG. 11 is a schematic of hardware components of an exemplary embodiment of an electronics control unit (ECU) 1160 that may be implemented. It should be noted that FIG. 11 is meant only to provide a generalized illustration of various components, any or all of which may be utilized as appropriate. It can be noted that, in some instances, components illustrated by FIG. 11 can be localized to a single physical device and/or distributed among various networked devices, which may be disposed at different physical locations. Moreover, it can be appreciate that, in an embodiment, the ECU 1160 can be configured to process data (i.e. audio signal(s)) and control operation of the in-car communication system. In another embodiment, the ECU 1160 can be configured to be in communication with remote processing circuitry configured to, in coordination with the ECU 1160, process data and control operation of the in-car communication system. The remote processing circuitry may be a centralized server or other processing circuitry separate from the ECU 1160 of the vehicle. The ECU 1160 is shown comprising hardware elements that can be electrically coupled via a BUS 1167 (or may otherwise be in communication, as appropriate). The hardware elements may include processing circuitry 1161 which can include without limitation one or more processors, one or more special-purpose processors (such as digital signal processing (DSP) chips, graphics acceleration processors, application specific integrated circuits (ASICs), and/or the like), and/or other processing structure or means. The above-described processors can be specially-programmed to perform operations including, among others, image processing and data processing. Some embodiments may have a separate DSP 1163, depending on desired functionality. It can be appreciated that the processes described herein may also be performed via analog circuitry in the absence of the DSP 1163.

According to an embodiment, the ECU 1160 can include one or more input device controllers 1170, which can control without limitation an in-vehicle touch screen, a touch pad, microphone(s), button(s), dial(s), switch(es), and/or the like. In an embodiment, one of the one or more input device controllers 1170 can be configured to control a microphone and can be configured to receive audio signal input(s) 1168 from one or more microphones of a microphone array of the present disclosure. Accordingly, the processing circuitry 1161 of the ECU 1160 may execute processes of the processes of the present disclosure responsive to the received audio signal input(s) 1168.

In an embodiment, each microphone of a microphone array can be controlled by a centralized digital signal processor via a digital audio bus. In an example, each microphone can be an electret, MEMS, or other, similar type microphone, wherein an output of each microphone can be analog or digital. In an example, the centralized digital signal processor can be one or more distributed, local digital signal processors located at each of the auditory devices. In an example, the digital audio bus may be used for transmitting received audio signals. Accordingly, the digital audio bus can be a digital audio bus allowing for the transmittal of a microphone digital audio signal, such as an A2B bus from Analog Devices, Inc.

According to an embodiment, the ECU 1160 can also include one or more output device controllers 1162, which can control without limitation a display, a visual indicator such as an LED, speakers, and the like. For instance, the one or more output device controllers 1162 can be configured to control audio output(s) 1175 of the speakers of a vehicle such that audio output(s) 1175 levels are controlled relative to ambient vehicle cabin noise, passenger conversation, and the like.

The ECU 1160 may also include a wireless communication hub 1164, or connectivity hub, which can include without limitation a modem, a network card, an infrared communication device, a wireless communication device, and/or a chipset (such as a Bluetooth device, an IEEE 802.11 device, an IEEE 802.16.4 device, a WiFi device, a WiMax device, cellular communication facilities including 4G, 5G, etc.), and/or the like. The wireless communication hub 1164 may permit data to be exchanged with, as described, in part, a network, wireless access points, other computer systems, and/or any other electronic devices described herein. The communication can be carried out via one or more wireless communication antenna(s) 1165 that send and/or receive wireless signals 1166.

Depending on desired functionality, the wireless communication hub 1164 can include separate transceivers to communicate with base transceiver stations (e.g, base stations of a cellular network) and/or access point(s). These different data networks can include various network types. Additionally, a Wireless Wide Area Network (WWAN) may be a Code Division Multiple Access (CDMA) network, a Time Division Multiple Access (TDMA) network, a Frequency Division Multiple Access (FDMA) network, an Orthogonal Frequency Division Multiple Access (OFDMA) network, a WiMax (IEEE 802.16), and so on. A CDMA network may implement one or more radio access technologies (RATs) such as cdma2000, Wideband-CDMA (W-CDMA), and so on. Cdma2000 includes IS-95, IS-2000, and/or IS-856 standards. A TDMA network may implement Global System for Mobile Communications (GSM), Digital Advanced Mobile Phone System (D-AMPS), or some other RAT. An OFDMA network may employ LTE, LTE Advanced, and so on, including 4G and 5G technologies.

The ECU 1160 can further include sensor controller(s) 1174. Such controllers can control, without limitation, one or more sensors of the vehicle, including, among others, one or more accelerometer(s), gyroscope(s), camera(s), radar(s), LiDAR(s), odometric sensor(s), and ultrasonic sensor(s), as well as magnetometer(s), altimeter(s), microphone(s), proximity sensor(s), light sensor(s), and the like. In an example, the one or more sensors includes a microphone(s) configured to measure ambient vehicle cabin noise, the measured ambient vehicle cabin noise being provided to the processing circuitry 1161 for incorporation within the methods of the present disclosure.

Embodiments of the ECU 1160 may also include a Satellite Positioning System (SPS) receiver 1171 capable of receiving signals 1173 from one or more SPS satellites using an SPS antenna 1172. The SPS receiver 1171 can extract a position of the device, using various techniques, from satellites of an SPS system, such as a global navigation satellite system (GNSS) (e.g., Global Positioning System (GPS)), Galileo over the European Union, GLObal NAvigation Satellite System (GLONASS) over Russia, Quasi-Zenith Satellite System (QZSS) over Japan, Indian Regional Navigational Satellite System (IRNSS) over India, Compass/BeiDou over China, and/or the like. Moreover, the SPS receiver 1171 can be used by various augmentation systems (e.g., an Satellite Based Augmentation System (SBAS)) that may be associated with or otherwise enabled for use with one or more global and/or regional navigation satellite systems. By way of example but not limitation, an SBAS may include an augmentation system(s) that provides integrity information, differential corrections, etc., such as, e.g., Wide Area Augmentation System (WAAS), European Geostationary Navigation Overlay Service (EGNOS), Multifunctional Satellite Augmentation System (MSAS), GPS Aided Geo Augmented Navigation or GPS and Geo Augmented Navigation system (GAGAN), and/or the like. Thus, as used herein an SPS may include any combination of one or more global and/or regional navigation satellite systems and/or augmentation systems, and SPS signals may include SPS, SPS-like, and/or other signals associated with such one or more SPS.

The ECU 1160 may further include and/or be in communication with a memory 1269. The memory 1169 can include, without limitation, local and/or network accessible storage, a disk drive, a drive array, an optical storage device, a solid-state storage device, such as a random access memory ("RAM"), and/or a read-only memory ("ROM"), which can be programmable, flash-updateable, and/or the like. Such storage devices may be configured to implement any appropriate data stores, including without limitation, various file systems, database structures, and/or the like.

The memory 1169 of the ECU 1160 also can comprise software elements (not shown), including an operating system, device drivers, executable libraries, and/or other code embedded in a computer-readable medium, such as one or more application programs, which may comprise computer programs provided by various embodiments, and/or may be designed to implement methods, and/or configure systems, provided by other embodiments, as described herein. In an aspect, then, such code and/or instructions can be used to configure and/or adapt a general purpose computer (or other device) to perform one or more operations in accordance with the described methods, thereby resulting in a special-purpose computer.

It will be apparent to those skilled in the art that substantial variations may be made in accordance with specific requirements. For example, customized hardware might also be used, and/or particular elements might be implemented in hardware, software (including portable software, such as applets, etc.), or both. Further, connection to other computing devices such as network input/output devices may be employed.

With reference to the appended Figures, components that can include memory can include non-transitory machine-readable media. The term "machine-readable medium" and "computer-readable medium" as used herein, refer to any storage medium that participates in providing data that causes a machine to operate in a specific fashion. In embodiments provided hereinabove, various machine-readable media might be involved in providing instructions/code to processing wits and/or other device(s) for execution. Additionally or alternatively, the machine-readable media might be used to store and/or carry such instructions/code. In many implementations, a computer-readable medium is a physical and/or tangible storage medium. Such a medium may take many forms, including but not limited to, non-volatile media, volatile media, and transmission media. Common forms of computer-readable media include, for example, magnetic and/or optical media, a RAM, a PROM, EPROM, a FLASH-EPROM, any other memory chip or cartridge, a carrier wave as described hereinafter, or any other medium from which a computer can read instructions and/or code.

The methods, apparatuses, and devices discussed herein are examples. Various embodiments may omit, substitute, or add various procedures or components as appropriate. For instance, features described with respect to certain embodiments may be combined in various other embodiments. Different aspects and elements of the embodiments may be combined in a similar manner. The various components of the figures provided herein can be embodied in hardware and/or software. Also, technology evolves and, thus, many of the elements are examples that do not limit the scope of the disclosure to those specific examples.

Obviously, numerous modifications and variations are possible in light of the above teachings. It is therefore to be understood that within the scope of the appended claims, the invention may be practiced otherwise than as specifically described herein.

Embodiments of the present disclosure may also be as set forth in the following parentheticals.

(1) A method for modulating an audio output of a microphone array, comprising receiving two or more audio signals from two or more microphone capsules in the microphone array, each audio signal comprising an electrical noise of a corresponding microphone capsule and a response to acoustic stimuli in an environment perceived by the microphone capsule, estimating an acoustic contribution level of the environment based on the received audio signals, and determining, by processing circuitry, a composition of the audio output of the microphone array based on the estimated acoustic contribution level of the environment, the composition being based on at least a relationship between acoustic noise and directivity indices of each of a plurality of beamformers.

(2) The method of (1), wherein the composition maximizes a signal to noise ratio of the microphone array by minimizing total noise of the microphone array.

(3) The method of either (1) or (2), wherein the estimating estimates the acoustic contribution level based on a received omnidirectional audio signal from an omnidirectional microphone capsule of the microphone array and a null speech signal based on processing the received two or more audio signals from the two or more microphone capsules in the microphone array according to a directional beamformer, the directional beamformer generating a null toward a speech origin in order to generate the null speech signal.

(4) The method of any one of (1) to (3), wherein the estimating estimates the acoustic contribution level based on a received omnidirectional audio signal from an omnidirectional microphone capsule and a received audio signal from a voice activity detector.

(5) The method of any one of (1) to (4), wherein the composition includes at least a portion of an output of one or more of the plurality of beamformers.

(6) The method of any one of (1) to (5), further comprising filtering, by the processing circuitry, the output of the one or more of the plurality of beamformers according to a frequency distribution of the received audio signals.

(7) The method of any one of (1) to (6), wherein the composition is based on the filtered output of the one or more of the plurality of beamformers.

(8) The method of any one of (1) to (7), wherein the filtering the output of the one or more of the plurality of beamformers is based on cutoff frequencies defined by directivity indices and electrical noise, the electrical noise being self-noise of an individual beamformer.

(9) The method of any one of (1) to (8), wherein the microphone array is a linear array of microphones including four microphones arranged such that a distance between a first microphone and a second microphone is equal to a distance between the second microphone and a third microphone, a distance between the first microphone and the third microphone being equal to a distance between the third microphone and a fourth microphone.

(10) An apparatus for modulating an audio output of a microphone array, comprising processing circuitry configured to receive two or more audio signals from two or more microphone capsules of a plurality of microphone capsules in the microphone array, each audio signal comprising an electrical noise of a corresponding microphone capsule and a response to acoustic stimuli in an environment perceived by the corresponding microphone capsule, estimate an acoustic contribution level of the environment based on the received audio signals, and determine a composition of the audio output of the microphone array based on the estimated acoustic contribution level of the environment, the composition being based on at least a relationship between acoustic noise and directivity indices of each of a plurality of beamformers.

(11) The apparatus of (11), wherein the composition maximizes a signal to noise ratio of the microphone array by minimizing total noise of the microphone array.

(12) The apparatus of either (10) or (11), wherein the processing circuitry is configured to estimate the acoustic contribution level based on a received omnidirectional audio signal from an omnidirectional microphone capsule of the microphone array and a null speech signal based on processing the received two or more audio signals from the two or more microphone capsules in the microphone array according to a directional beamformer, the directional beamformer generating a null toward a speech origin in order to generate the null speech signal.

(13) The apparatus of any one of (10) to (12), wherein the processing circuitry is configured to estimate the acoustic contribution level based on a received onmidirectional audio signal from an omnidirectional microphone capsule and a received audio signal from a voice activity detector.

(14) The apparatus of any one of (10) to (13), wherein the composition includes at least a portion of an output of one or more of the plurality of beamformers.

(15) The apparatus of any one of (10) to (14), wherein the processing circuitry is further configured to filter the output of the one or more of the plurality of beamformers according to a frequency distribution of the received audio signals based on cutoff frequencies defined by directivity indices and electrical noise, the electrical noise being self-noise of an individual beamformer.

(16) The apparatus of any one of (10) to (15), wherein the composition is based on the filtered output of the one or more of the plurality of beamformers.

(17) The apparatus of any one of (10) to (16), wherein the processing circuitry is further configured to filter the output of the one or more of the plurality of beamformers based on cutoff frequencies defined by directivity indices and electrical noise, the electrical noise being self-noise of an individual beamformer.

(18) The apparatus of any one of (10) to (17), wherein the microphone array is a linear array of microphones including four microphones arranged such that a distance between a first microphone and a second microphone is equal to a distance between the second microphone and a third microphone, a distance between the first microphone and the third microphone being equal to a distance between the third microphone and a fourth microphone.

(19) A non-transitory computer-readable storage medium storing computer-readable instructions that, when executed by a computer, cause the computer to perform a method for modulating an audio output of a microphone array, the method comprising receiving two or more audio signals from two or more microphone capsules in the microphone array, each audio signal comprising an electrical noise of a corresponding microphone capsule and a response to acoustic stimuli in an environment perceived by the microphone capsule, estimating an acoustic contribution level of the environment based on the received audio signals, and determining a composition of the audio output of the microphone array based on the estimated acoustic contribution level of the environment, the composition being based on at least a relationship between acoustic noise and directivity indices of each of a plurality of beamformers.

(20) The non-transitory computer-readable storage medium of (19), wherein the estimating estimates the acoustic contribution level based on a received omnidirectional audio signal from an omnidirectional microphone capsule of the microphone array and a null speech signal based on processing the received two or more audio signals from the two or more microphone capsules in the microphone array according to a directional beamformer, the directional beamformer generating a null toward a speech origin in order to generate the null speech signal.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, defines, in part, the scope of the foregoing claim terminology such that no inventive subject matter is dedicated to the public.

The invention claimed is:

1. A method for modulating an audio output of a microphone array, comprising:

receiving two or more audio signals from two or more microphone capsules in the microphone array, each audio signal comprising an electrical noise of a corresponding microphone capsule and a response to acoustic stimuli in an environment perceived by the microphone capsule;

estimating an acoustic contribution level of the environment based on the received audio signals; and determining, by processing circuitry, a composition of the audio output of the microphone array based on the estimated acoustic contribution level of the environment, the composition being based on at least a relationship between acoustic noise and directivity indices of each of a plurality of beamformers.

2. The method of claim 1, wherein the composition maximizes a signal to noise ratio of the microphone array by minimizing total noise of the microphone array.

3. The method of claim 1, wherein the estimating estimates the acoustic contribution level based on a received omnidirectional audio signal from an omnidirectional microphone capsule of the microphone array and a null speech signal based on processing the received two or more audio signals from the two or more microphone capsules in the microphone array according to a directional beamformer, the directional beamformer generating a null toward a speech origin in order to generate the null speech signal.

4. The method of claim 1, wherein the estimating estimates the acoustic contribution level based on a received omnidirectional audio signal from an omnidirectional microphone capsule and a received audio signal from a voice activity detector.

5. The method of claim 1, wherein the composition includes at least a portion of an output of one or more of the plurality of beamformers.

6. The method of claim 5, further comprising filtering, by the processing circuitry, the output of the one or more of the plurality of beamformers according to a frequency distribution of the received audio signals.

7. The method of claim 6, wherein the composition is based on the filtered output of the one or more of the plurality of beamformers.

8. The method of claim 7, wherein the filtering the output of the one or more of the plurality of beamformers is based on cutoff frequencies defined by directivity indices and electrical noise, the electrical noise being self-noise of an individual beamformer.

9. The method of claim 1, wherein the microphone array is a linear array of microphones including four microphones arranged such that a distance between a first microphone and a second microphone is equal to a distance between the second microphone and a third microphone, a distance between the first microphone and the third microphone being equal to a distance between the third microphone and a fourth microphone.

10. An apparatus for modulating an audio output of a microphone array, comprising:

processing circuitry configured to receive two or more audio signals from two or more microphone capsules of a plurality of microphone capsules in the microphone array, each audio signal comprising an electrical noise of a corresponding microphone capsule and a response to acoustic stimuli in an environment perceived by the corresponding microphone capsule, estimate an acoustic contribution level of the environment based on the received audio signals, and determine a composition of the audio output of the microphone array based on the estimated acoustic contribution level of the environment, the composition being based on at least a relationship between acoustic noise and directivity indices of each of a plurality of beamformers.

11. The apparatus of claim 10, wherein the composition maximizes a signal to noise ratio of the microphone array by minimizing total noise of the microphone array.

12. The apparatus of claim 10, wherein the processing circuitry is configured to estimate the acoustic contribution level based on a received omnidirectional audio signal from an omnidirectional microphone capsule of the microphone array and a null speech signal based on processing the received two or more audio signals from the two or more microphone capsules in the microphone array according to a directional beamformer, the directional beamformer generating a null toward a speech origin in order to generate the null speech signal.

13. The apparatus of claim 10, wherein the processing circuitry is configured to estimate the acoustic contribution level based on a received omnidirectional audio signal from an omnidirectional microphone capsule and a received audio signal from a voice activity detector.

14. The apparatus of claim 10, wherein the composition includes at least a portion of an output of one or more of the plurality of beamformers.

15. The apparatus of claim 14, wherein the processing circuitry is further configured to filter the output of the one or more of the plurality of beamformers according to a frequency distribution of the received audio signals based on cutoff frequencies defined by directivity indices and electrical noise, the electrical noise being self-noise of an individual beamformer.

16. The apparatus of claim 15, wherein the composition is based on the filtered output of the one or more of the plurality of beamformers.

17. The apparatus of claim 16, wherein the processing circuitry is further configured to filter the output of the one or more of the plurality of beamformers based on cutoff frequencies defined by directivity indices and electrical noise, the electrical noise being self-noise of an individual beamformer.

18. The apparatus of claim 10, wherein the microphone array is a linear array of microphones including four microphones arranged such that a distance between a first microphone and a second microphone is equal to a distance between the second microphone and a third microphone, a distance between the first microphone and the third microphone being equal to a distance between the third microphone and a fourth microphone.

19. A non-transitory computer-readable storage medium storing computer-readable instructions that, when executed by a computer, cause the computer to perform a method for modulating an audio output of a microphone array, the method comprising:

receiving two or more audio signals from two or more microphone capsules in the microphone array, each audio signal comprising an electrical noise of a corresponding microphone capsule and a response to acoustic stimuli in an environment perceived by the microphone capsule, estimating an acoustic contribution level of the environment based on the received audio signals; and determining a composition of the audio output of the microphone array based on the estimated acoustic contribution level of the environment, the composition being based on at least a relationship between acoustic noise and directivity indices of each of a plurality of beamformers.

20. The non-transitory computer-readable storage medium of claim 19, wherein the estimating estimates the acoustic contribution level based on a received omnidirectional audio signal from an omnidirectional microphone capsule of the microphone array and a null speech signal based on processing the received two or more audio signals from the two or more microphone capsules in the microphone array according to a directional beamformer, the directional beamformer generating a null toward a speech origin in order to generate the null speech signal.

* * * * *